US006796836B2

(12) United States Patent
Ichida et al.

(10) Patent No.: US 6,796,836 B2
(45) Date of Patent: Sep. 28, 2004

(54) CONNECTOR, A DISENGAGEMENT JIG AND A METHOD

(75) Inventors: Kiyofumi Ichida, Yokkaichi (JP); Yukihiro Fukatsu, Yokkaichi (JP); Toshikazu Sakurai, Yokkaichi (JP); Shinya Fujita, Yokkaichi (JP); Yuuichi Nankou, Yokkaichi (JP); Hajime Kawase, Yokkaichi (JP); Ryotaro Ishikawa, Yokkaichi (JP); Naoya Kurimoto, Yokkaichi (JP)

(73) Assignee: Sumitomo Wiring Systems, Inc., Yokkaichi (JP)

( * ) Notice: Subject to any disclaimer, the term of this patent is extended or adjusted under 35 U.S.C. 154(b) by 0 days.

(21) Appl. No.: 10/364,844

(22) Filed: Feb. 11, 2003

(65) Prior Publication Data

US 2003/0228795 A1 Dec. 11, 2003

(30) Foreign Application Priority Data

Jun. 6, 2002 (JP) ..... 2002-166360
Jun. 6, 2002 (JP) ..... 2002-166364
Jul. 6, 2002 (JP) ..... 2002-167929

(51) Int. Cl.[7] ..... H01R 13/40
(52) U.S. Cl. ..... 439/595; 439/752; 439/744
(58) Field of Search ..... 439/594–596, 439/572, 744

(56) References Cited

U.S. PATENT DOCUMENTS 5,187,862 A 2/1993 Ohsumi
5,839,921 A 11/1998 Yamanashi
6,338,654 B1 * 1/2002 Sasaki et al. ..... 439/595
6,626,701 B2 * 9/2003 Yoshida et al. ..... 439/595
6,655,993 B1 * 12/2003 Yamamoto ..... 439/595

FOREIGN PATENT DOCUMENTS

DE G 93 08 114.8 12/1993
EP 0 986 143 A1 3/2000

* cited by examiner

*Primary Examiner*—Truc T. T. Nguyen
(74) *Attorney, Agent, or Firm*—Gerald E. Hespos; Anthony J. Casella

(57) ABSTRACT

A female housing (10) has cavities (11) into which female terminal fittings (30) are insertable from behind. A lock (13) projects forward from its base end and is restorable after being temporarily resiliently deformed by the female terminal fitting (30) being inserted, thereby engaging and locking the female terminal fitting (30) in the cavity (11). Maneuverable recesses (24) maneuverable by a disengagement jig (60) from front are provided at positions on the front surface of each lock (13) retracted from the locked terminal fitting (30) and within a width range of a locking surface of the lock (13) engageable with the terminal fitting (30) and located more toward the base end of the locking portion than the locking surface.

12 Claims, 29 Drawing Sheets

CONNECTOR, A DISENGAGEMENT JIG AND A METHOD

BACKGROUND OF THE INVENTION

1. Field of the Invention

The invention relates to a connector, a disengagement jig and to a method for dismounting a connector.

2. Description of the Related Art

Japanese Unexamined Patent Publication No. 6-325814 and FIG. 29 herein disclose a connector. As shown in FIG. 29, the connector has a housing 1 and terminal fittings 2 that are inserted into cavities 3 in the housing 1. The housing 1 also has deformation permitting spaces 4 and resiliently deformable locks 5 are disposed between the cavities 3 and the deformation permitting spaces 4. The locks 5 are deformed into the deformation permitting spaces 4 as the terminal fittings 2 are inserted into the cavities 3. However, the locks 5 are restored resiliently to engage and lock the terminal fittings 2. Each lock 5 has an arm 6 cantilevered forward from an upper wall of the cavity 3. Each lock 5 also has a locking projection 7 that projects into the cavity 3 from the bottom surface of a front part of the arm 6 for engaging the terminal fitting 2, and a disengaging projection 8 that projects more forward than the locking projection 7.

The terminal fitting 2 can be disengaged from the lock 5 by inserting a jig into the front side of the housing 1 to move the disengaging projection 8 of the lock 5 up. Thus, the lock 5 is deformed away from the terminal fitting 2.

The terminal fitting 2 may be detached by deforming the lock 5 a distance equal to the height of an engagement area between the locking projection 8 and the terminal fitting 2. The disengaging portion 8 is displaced by a distance longer than the height of the engagement area. Thus, the housing 1 needs a deformation permitting space 4 that permits the degree of displacement of the disengaging portion 8 above the lock 5. This undesirably enlarges the connector with respect to the height direction.

As a countermeasure, the disengaging portions may be formed to project from the side surfaces of the locks 5. However, such an arrangement extends the widthwise dimension of the cavities 3, resulting in a wider connector.

The invention was developed in view of the above, and an object thereof is to provide a connector that can be miniaturized effectively, a disengagement jig for such a connector and a method for dismounting such a connector.

SUMMARY OF THE INVENTION

The invention is a connector comprising a housing with at least one cavity for receiving a terminal fitting from behind. A lock projects forward in the cavity and is deformed into a deformation permitting space as the terminal fitting is inserted into the cavity. However, the lock is restored resiliently to engage and lock the terminal fitting. The leading surface of the lock has a maneuverable recess spaced from the locked terminal fitting and located within a width range of the surface of the lock that engages the terminal fitting. The maneuverable recess is maneuverable by a disengagement jig preferably from the front to deform the lock and disengage the lock from the terminal fitting so that the terminal fitting can be withdrawn from the cavity.

The maneuverable recess preferably is more toward the deformation permitting space than the locking surface. Thus, the height of the deformation permitting space for the lock in the connector housing need not be larger than a degree of displacement of the locking surface during the resilient deformation. In addition, the maneuverable recess is located within the width range of the locking surface that engages the terminal fitting. Thus, the cavity need not be extended in the widthwise direction, and the connector can be miniaturized.

Preferably, two maneuverable recesses are arranged along the widthwise direction to balance forces and prevent twisting deformation.

The maneuverable recess preferably is arranged to be exposed to the outside of the connector, even if the terminal fitting is locked by the lock.

The maneuverable recess may be undercut to converge along an insertion and withdrawal direction of the terminal fitting into and from the housing.

Most preferably, a surface of the maneuverable recess towards the terminal fitting is substantially parallel to the terminal fitting.

The invention also relates to a disengagement jig for the connector. The jig comprises a main body, a disengaging portion at the leading end of the main body and a restricting portion. The disengaging portion can maneuver the maneuverable recess by the leverage action of the main body. The restricting portion contacts the front surface of the connector housing during the leverage action to restrict the inclination range of the main body. Thus, the lock is prevented from undergoing an excessive resilient deformation.

The main body may comprise a receiving portion for receiving a tab of the terminal fitting projecting from the front surface of the connector housing. An inner surface of the receiving portion is formed with an escaping portion for avoiding interference with the tab when the main body is operated.

The tab of the terminal fitting projecting from the front surface of the connector housing is received in the receiving portion when the disengaging portion is inserted into the maneuverable recess. The lock is deformed by the disengaging portion when the main body is operated in this state, and interference with the tab is avoided by the escaping portion.

The invention also relates to a method for dismounting a connector. The method comprises providing a housing with at least one cavity into which a terminal fitting is inserted, and a lock that projects forward in the cavity. The lock is deformed temporarily into a deformation permitting space as the terminal fitting is inserted but then is restored to engage and lock the terminal fitting. The method comprises maneuvering a maneuverable recess by a disengagement jig through a mold removal hole of the connector. The maneuverable recess is at the leading surface of the lock, but is spaced from the locked terminal fitting and is within a width range of a locking surface of the lock that is engageable with the terminal fitting, thereby disengaging the lock from the terminal fitting. The method then comprises withdrawing the terminal fitting from the cavity.

The maneuvering step may comprise maneuvering a pair of maneuverable recesses arranged along a widthwise direction.

These and other features of the invention will become more apparent upon reading of the following detailed description and accompanying drawings. It should be understood that even though embodiments are described separately, single features thereof may be combined to additional embodiments.

DETAILED DESCRIPTION OF THE PREFERRED EMBODIMENTS

A female connector according to the invention is illustrated in FIGS. 1 to 28. The female connector includes a female housing 10 and female terminal fittings 30 that are inserted into the female housing 10. The female housing 10 can be connected with a male housing (not shown) so that the female terminal fittings 30 are connected electrically with male terminal fittings in the male housing. In the following description, directions IWD of inserting and withdrawing the female terminal fittings 30 into and from the female housing 10 are referred to as a forward direction and a backward direction, respectively, and reference is made to FIG. 8 concerning the vertical direction.

Figure 1:
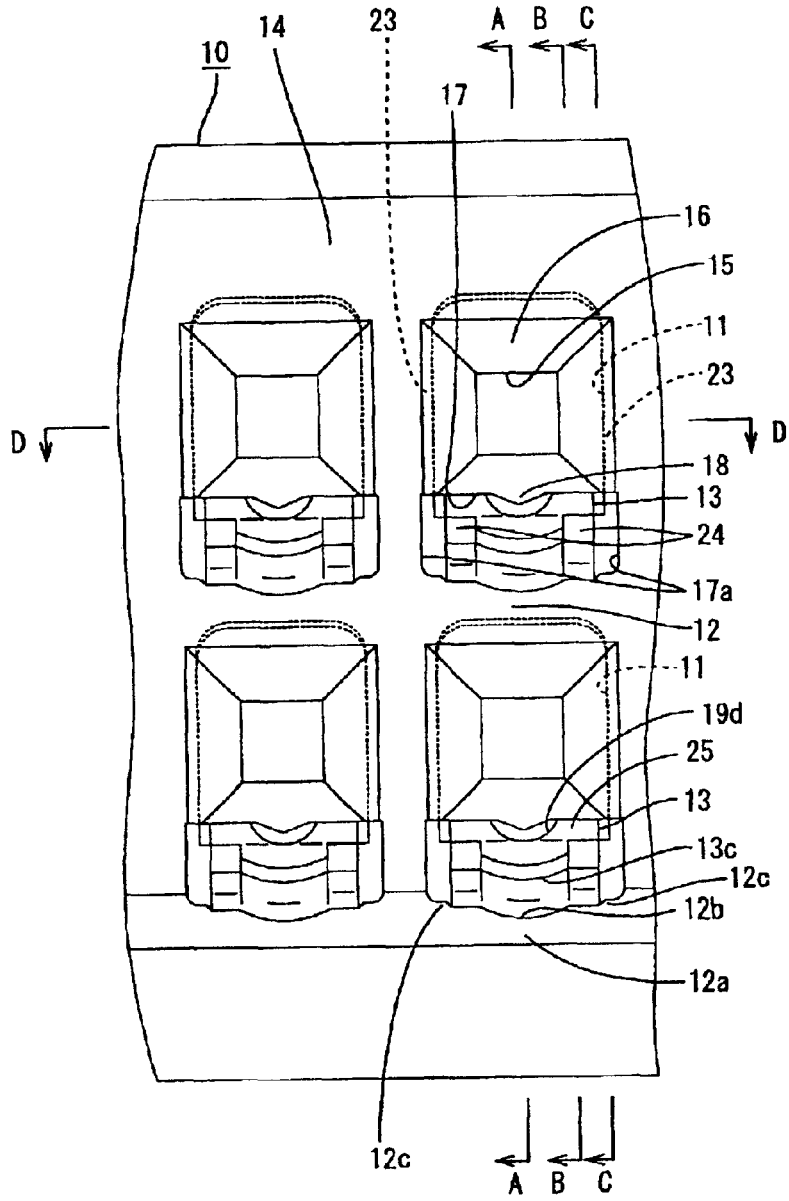
FIG. 1 is a front view of a female housing according to the invention.
Figure 8:
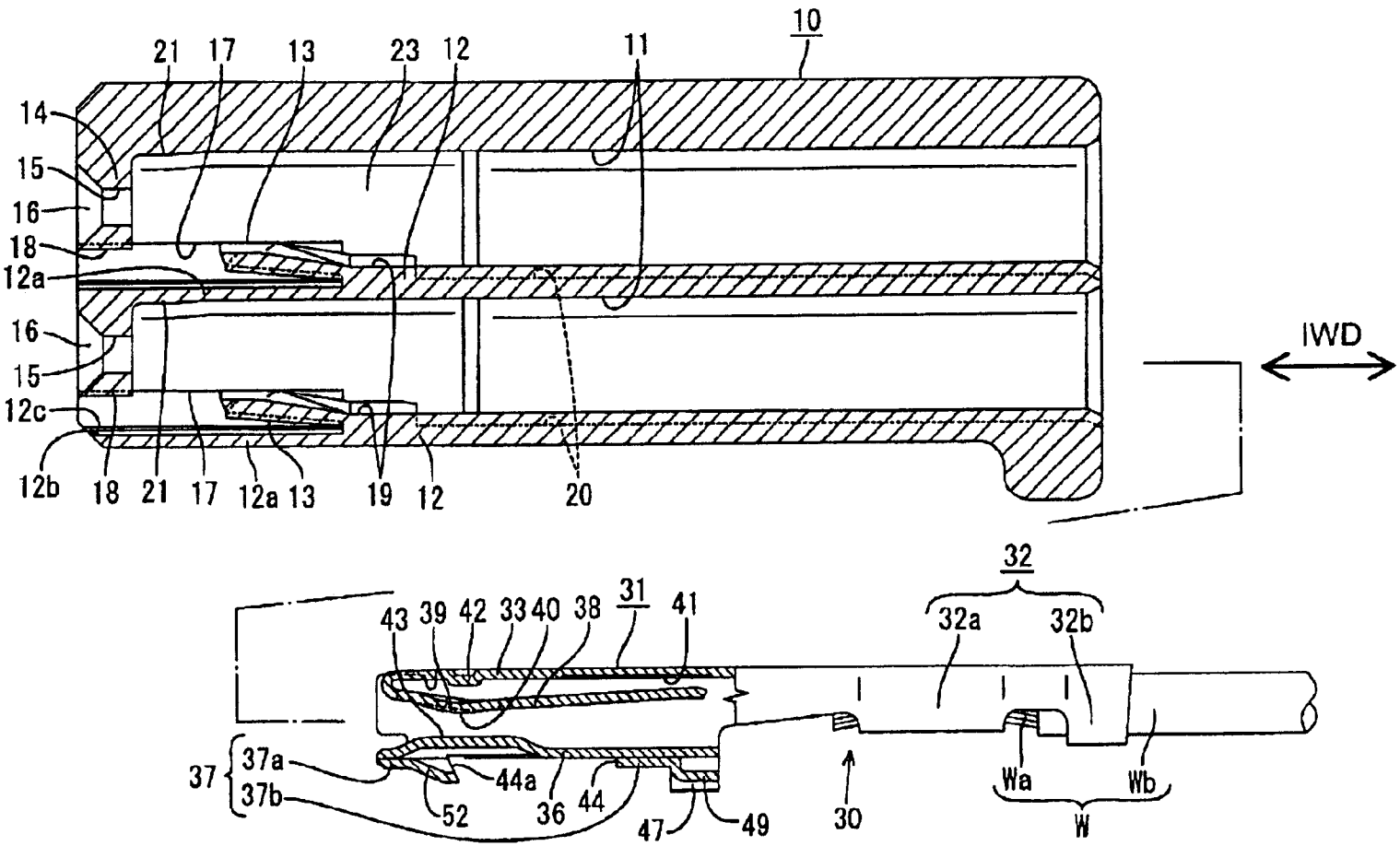
FIG. 8 is a sectional view of the female housing taken along line A—A of FIG. 1 and a sectional view of the female terminal fitting taken along line E—E of FIG. 4 before the female terminal fitting is inserted into the female housing.

The female housing 10 is molded e.g. of a resin by front and rear molds that close and open substantially along forward and backward directions. Cavities 11 are arranged substantially side by side in the female housing 10 along the widthwise direction at two stages, as shown in FIGS. 1 and 8. Each cavity 11 has a bottom wall 12 and a lock 13 projects from the bottom wall 12 of each cavity 11 for locking the female terminal fittings 30 in the respective cavities 11. The female housing 10 also has a front wall 14 that defines the front-limit position for the terminal fittings 30 in the respective cavities 11. The front wall 14 of the female housing 10 is formed with tab insertion holes 15 for permitting tabs of the mating male terminal fittings to be inserted into the cavities 11 from the front. Converging guide surfaces 16 are formed over substantially the entire periphery of the front edges of the tab insertion holes 15 for guiding insertion of tabs of the male terminal fittings. Mold removal holes 15 are formed on the front wall 14 of the female housing 10 below the tab insertion holes 15 and at positions displaced in a deforming direction DD of the locks 13 from the tab insertion holes 15. The mold-removal holes 17 are used to remove the front mold for forming the lock 13 at the time of molding the female housing 10. A substantially triangular projection 18 projects down at the widthwise center of the upper end of each mold-removal hole 17 in the front wall 14, and the guide surface 16 is formed continuously at the projecting portion 18.

About ¼ of the front of the bottom wall 12 of each cavity 11 projects down to form a lowered portion 12*a*, and the cantilevered lock 13 projects forward from the lowered portion 12*a*. The lock 13 inclines up to the front and into the cavity 11. Additionally, the lock 13 is resiliently deformable about a rear base end as a supporting point. Thus, the front end of the lock 13 is deformable down in a deformation direction DD when a portion of the lock 13 that projects into the cavity 11 is pressed by the female terminal fitting 30 being inserted. The deformation causes the lock 13 to retract into a deformation permitting space defined in the lowered portion 12*a* of the bottom wall 12. The lowered portion 12*a* of the bottom wall 12 facing the lock 13 from below prevents an excessive deformation of the lock 13 by engaging the lower surface of the lock 13 at a stage before the lock 13 undergoes a deformation beyond its resiliency limit. The lock 13 is covered by the lowered portion 12*a* of the bottom wall 12 connected with the front wall 14 over substantially the entire width without being exposed to the cavity 11 below or to the outside below the female housing 10, thereby being protected.

Figure 2:
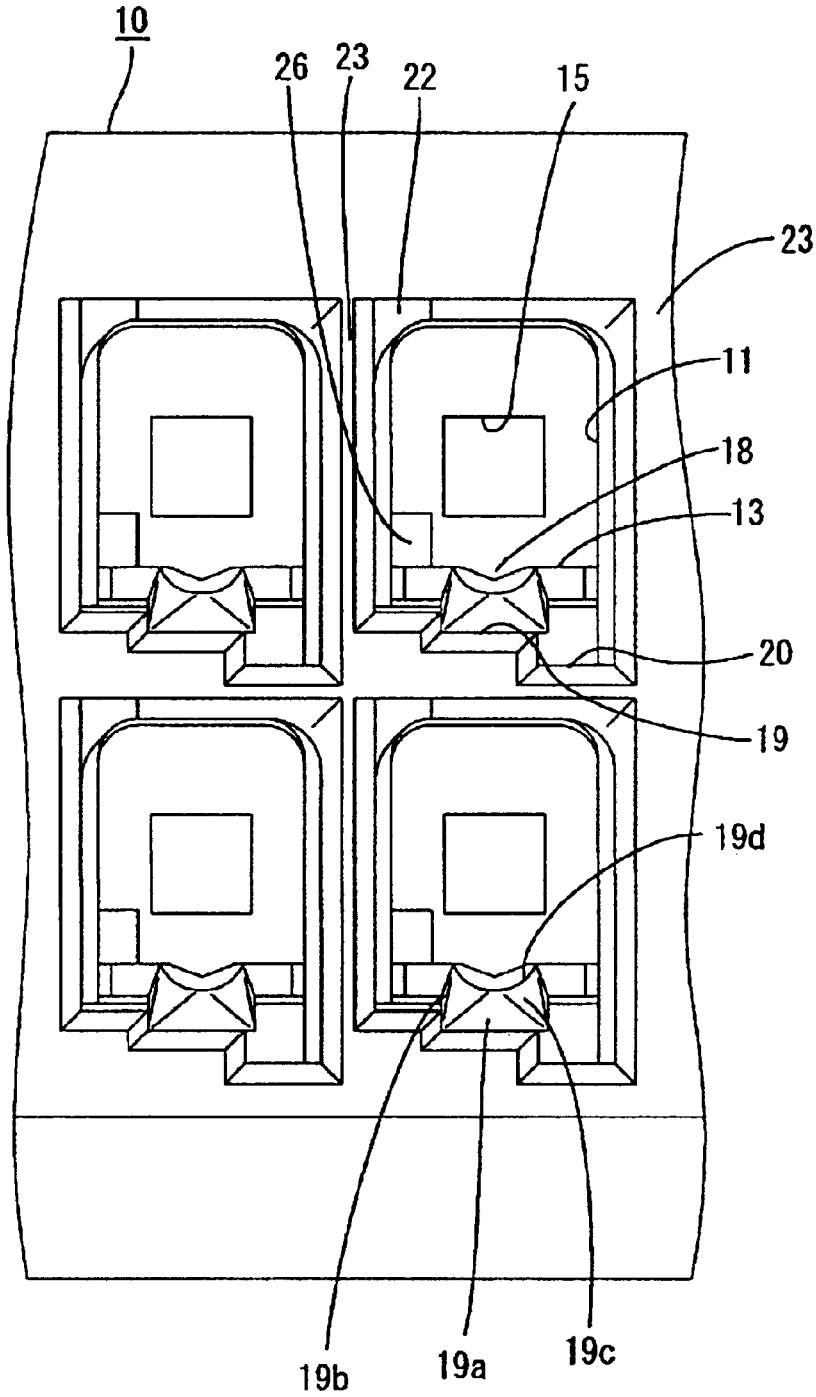
FIG. 2 is a rear view of the female housing.

Grooves are formed at a portion of the bottom wall 12 of the cavity 11 behind the lock 13, as shown in FIGS. 2 and 8. Specifically, a projection-inserting groove 19 is formed substantially in the widthwise center of the bottom wall 12, and a stabilizer-inserting groove 20 is formed at the right side of the projection-inserting groove 19 in FIG. 2. The projection-inserting groove 19 is substantially continuous with the lock 13, whereas the front end of the stabilizer-inserting groove 20 is slightly behind the lock 13. The bottom wall 12, the projection-inserting groove 19 and the stabilizer-insertion groove 20 define a stair-like shape in widthwise direction (see FIG. 2).

Figure 11:
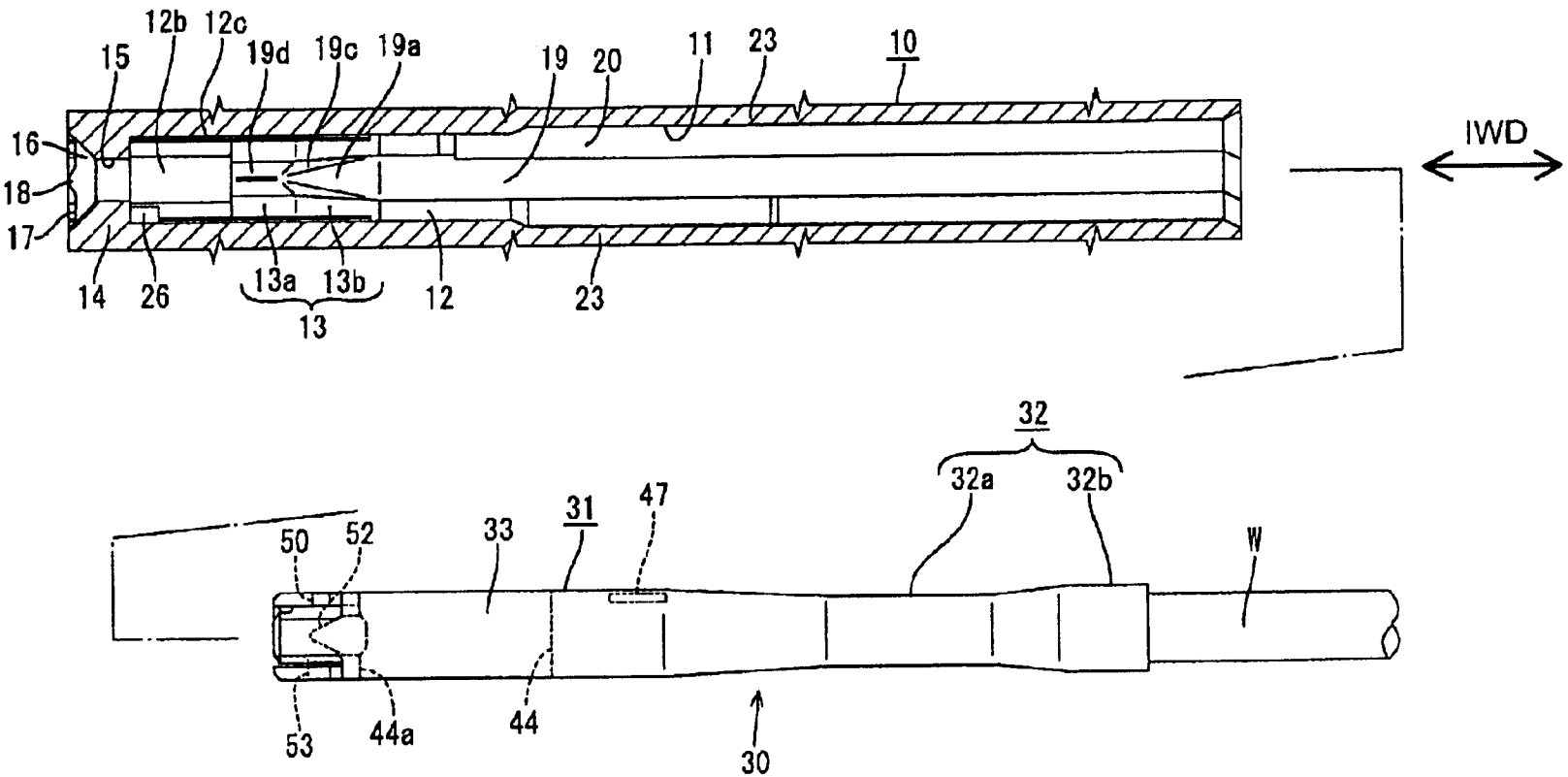
FIG. 11 is a sectional view of the female housing taken along D—D of FIG. 1 and the female terminal fitting is shown by a plan view before the female terminal fitting is inserted into the female housing.

A jutting portion 21 is provided at the front end of the upper surface of the cavity 11 and gradually projects in toward the lock 13 over the entire width of the cavity 11. The front end of the female terminal fitting 30 inserted into the cavity 11 is pushed toward the lock 13 by the jutting portion 21 to increase a depth of engagement with the lock 13. The peripheral edge of the rear end of the cavity 11 is inclined inwardly to the front substantially over substantially the entire periphery except only a part to guide the female terminal fitting 30. A restriction 22 is provided at an upper-left position of the peripheral edge of the rear end of the cavity 11 in FIG. 2 and extends substantially normal to the inserting and withdrawing directions IWD of the female terminal fitting 30. The restriction 22 contacts the stabilizer 47 when the female terminal fitting 30 is upside down, into the cavity 11. Further, opposite sidewalls 23 of the cavity 11 bulge in so that a substantially front half is narrower than a substantially rear half, as shown in FIG. 11.

Figure 3:
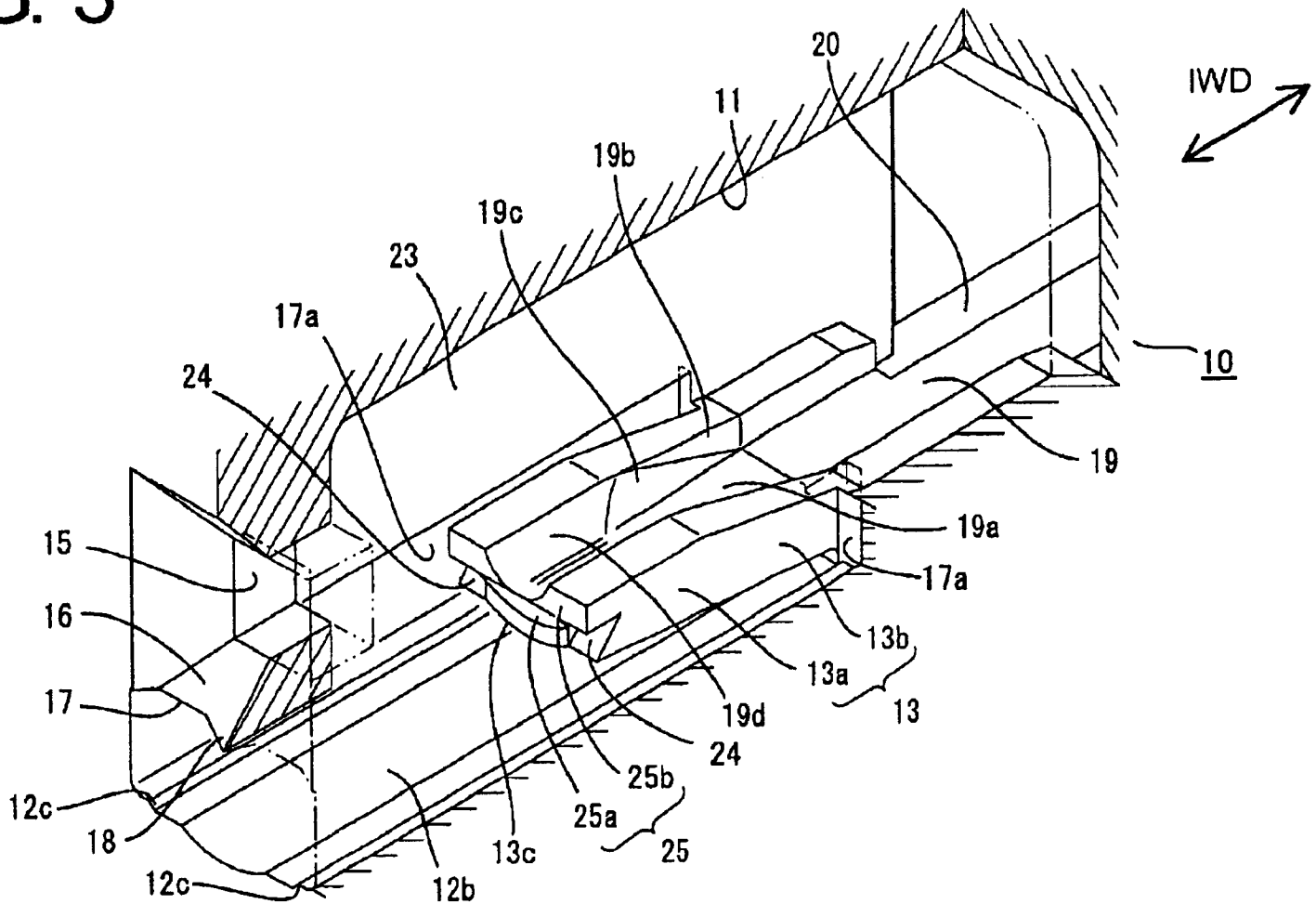
FIG. 3 is a perspective view partly in section of the female housing.

The lock 13 has upper and lower surfaces and front and rear parts 13*a* and 13*b*, as shown in FIG. 3. The lower surface of the lock 13 inclines moderately up to the front over substantially the entire length. The rear part 13*b* of the lock 13 has an upper surface that is slanted up and to the front with a slope slightly steeper than the lower surface. However the front part 13*a* of the lock 13 has an upper surface that is substantially horizontal and parallel to the inserting and withdrawing directions IWD of the terminal fitting 30. A projection-inserting groove 19 is formed in the widthwise center of the upper surface of the lock 13 and extends continuously over the entire length of the lock 13 from the rear side of the bottom wall 12. The projection-inserting groove 19 gradually narrows to the front along the rear part 13*b* of the lock 13 and is defined by a bottom surface 19*a*, a pair of vertical side surfaces 19*b* and a pair of inwardly slanted surfaces 19*c* that couple the opposite side surfaces 19*b* and the bottom surface 19*a*. The projection-introducing groove 19 has a constant width along the front part 13*a* of the lock 13 and defines an arcuate surface 19*d*. A convex arcuate surface 13*c* is formed at the widthwise center of the lower surface of the lock 13 and is curved more moderately over the entire length than the arcuate surface 19*d* of the projection-introducing groove 19. A concave arcuate surface 12*b* is formed at the lowered portion 12*a* of the bottom wall 12. Bulges 12*c* project slightly up at the opposite sides of the arcuate surface 12*b* of the lowered portion 12*a* of the bottom wall 12.

The lock 13 and the cavity 11 are of substantially constant widths along their lengths, but the lock 13 is slightly narrower than the cavity 11. The mold-removal hole 17 in the front wall 14 of the female housing 10 is wider than the cavity 11. Accordingly, notches 17*a* of a specified width are formed in the opposite side walls 23 of the cavity 11 substantially facing the opposite sides of the lock 13. The thickness of the mold for molding the lock 13 can be made larger by the widths of the notches 17*a* and, thus, a necessary strength can be secured for the mold. Conversely, the lock 13 is wider to enhance its strength.

Maneuverable recesses 24 open forward at opposite sides of the front end of the lock 13 and extend up for about the lower ⅗ of the total height of the lock 13. The maneuverable recesses 24 are retracted backward and are exposed forward to outside even if the female terminal fitting 30 is locked by the lock 13 (see FIG. 17). Each maneuverable recess 24 is substantially triangular when the lock 13 is viewed sideways. The upper surface of each maneuverable recess 24 is substantially horizontal, whereas the lower surface is inclined up and to the back (see FIG. 3).

A projection 25 projects forward over the entire width at about the upper ⅔ of the total height of the front end of the lock 13. The projection 25 has a lower part 25*a* with a projecting length that gradually increases toward the upper end and an upper part 25*b* above the maneuverable recesses 24 that has a constant projecting length. Thus, the front-end surface of the lower part 25*a* of the projecting portion 25 slants up to the front, whereas the front-end surface of the upper part 25*b* is substantially vertical.

Figure 10:
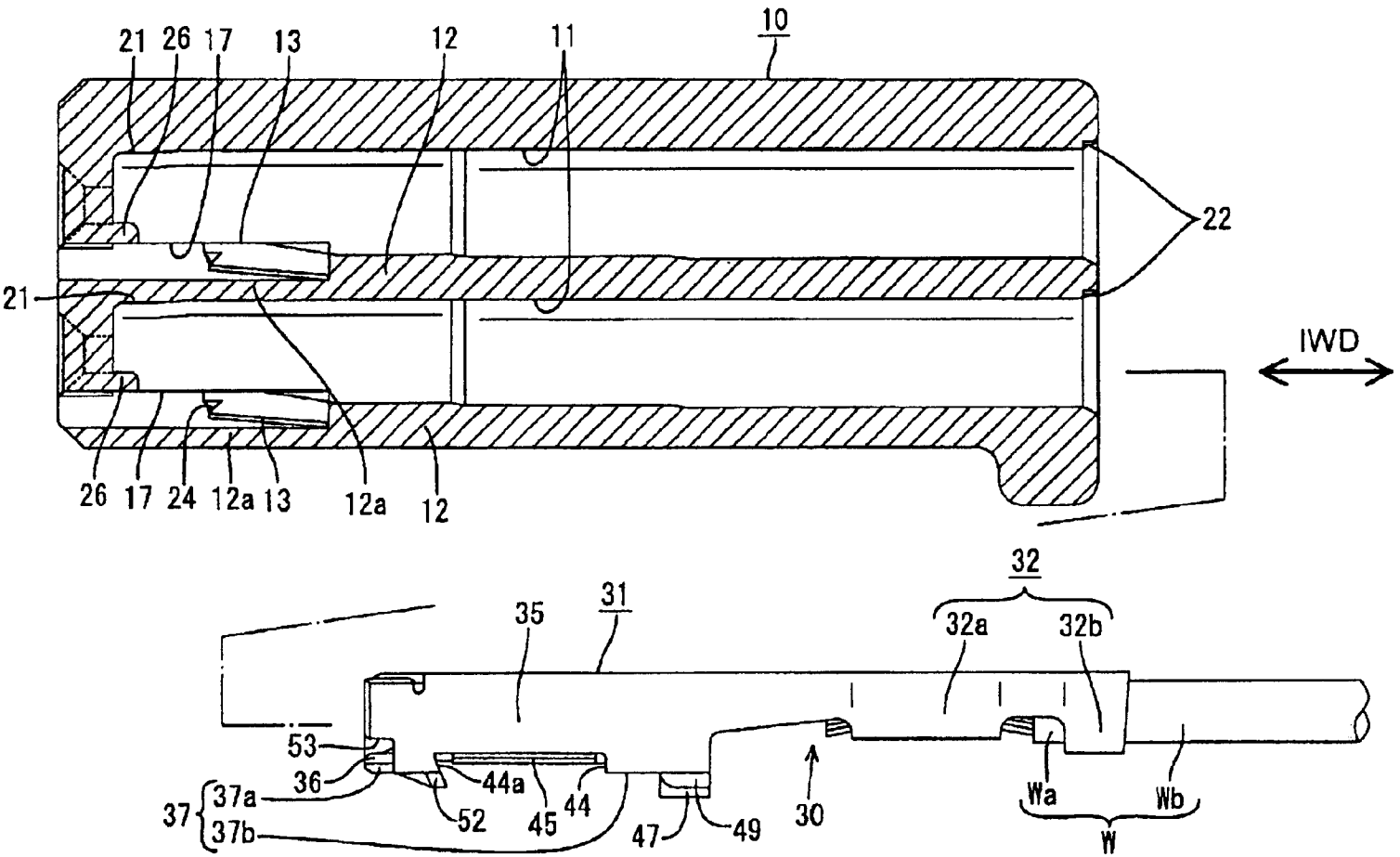
FIG. 10 is a sectional view of the female housing taken along line C—C of FIG. 1 and a right side view of the female terminal fitting before the female terminal fitting is inserted into the female housing.

As shown in FIGS. 2 and 10, a support 26 projects in at a corner of the front end of the cavity 11 and is fittable into a groove 53 in the female terminal fitting 30 to prevent the female terminal fitting 30 from being vertically inclined. The support 26 is substantially block-shaped and is coupled to the front wall 14 of the female housing 10 and the left sidewall 23 of the cavity 11 in FIG. 2 to enhance the strength of the support 26. The support 26 is displaced up in the cavity 11 with respect to the lock 13 and the lower surface thereof faces the mold-removal hole 17.

Figure 5:
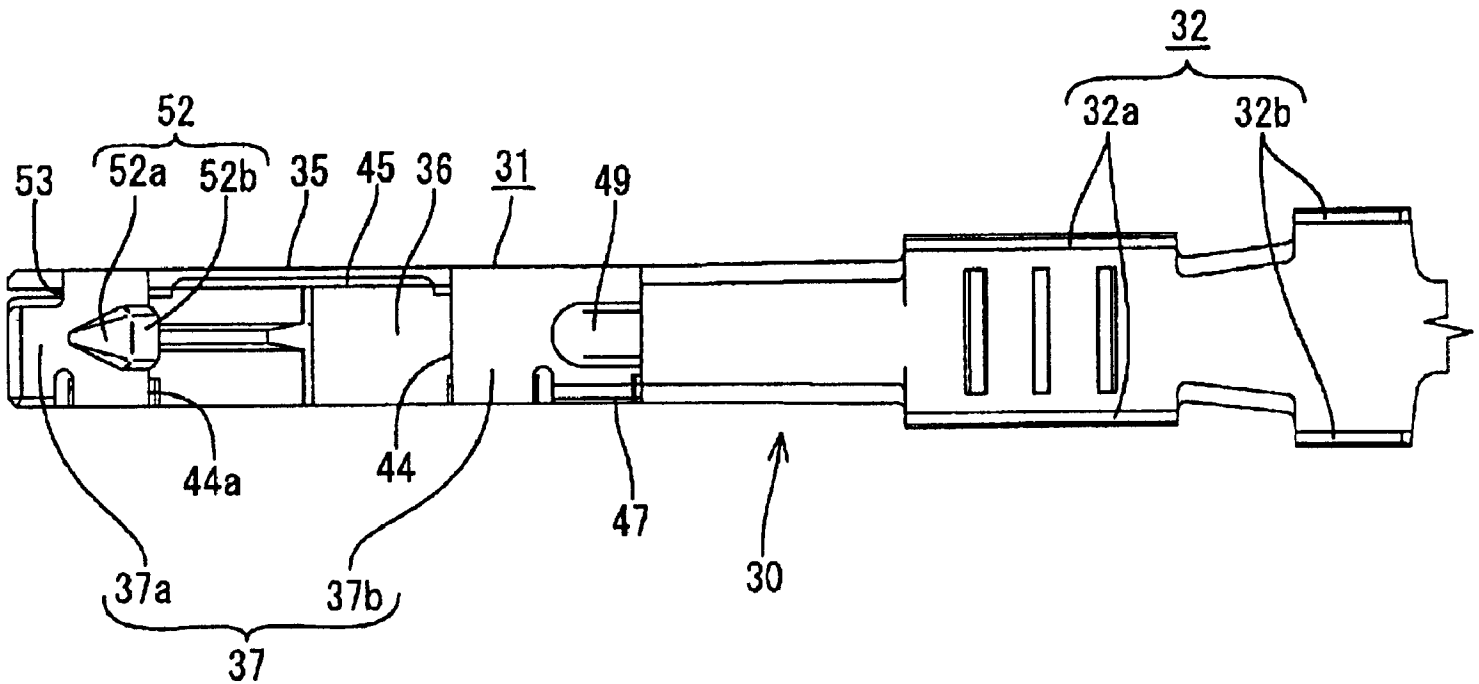
FIG. 5 is a bottom view of the female terminal fitting.

The female terminal fitting 30 is formed into a desired shape by embossing, folding and/or bending a metallic material stamped or cut out into a specified shape. The female terminal fitting 30, as shown in FIGS. 5 and 8, has a main portion 31 substantially in the form of a box with open front and rear ends and a barrel 32 to be crimped, bent or folded into connection with an end of a wire W. The barrel 32 has front crimping pieces 32*a* that are crimped, bent or folded into connection with a core Wa of the wire W, and rear crimping pieces 32*b* that are crimped, bent or folded into connection with an insulated portion Wb of the wire W.

Figure 4:
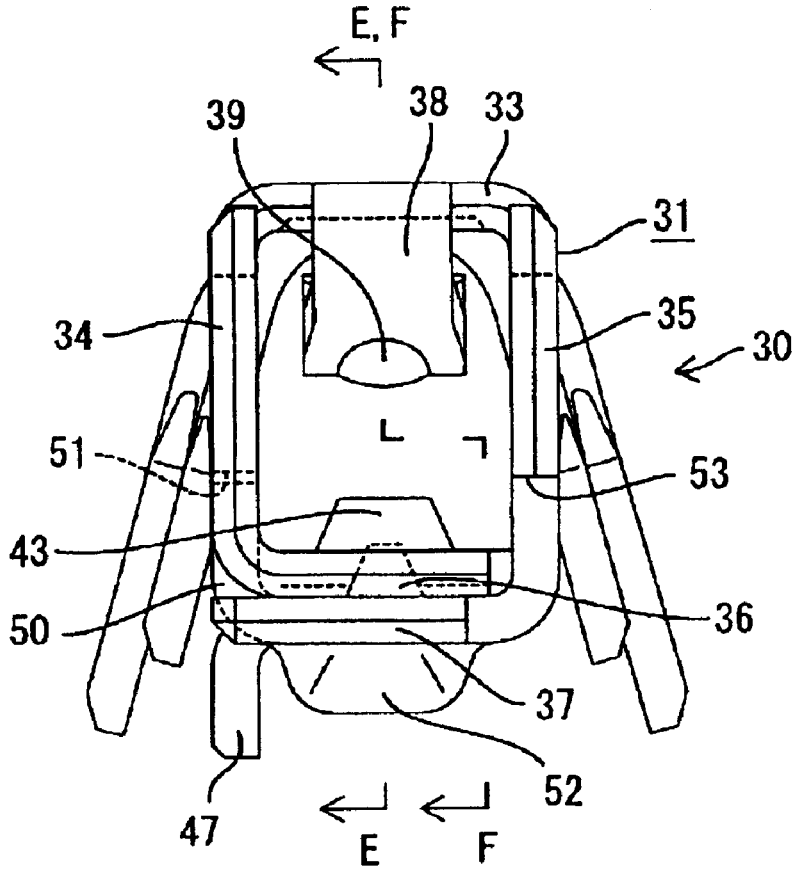
FIG. 4 is a front view of a female terminal fitting.

The main portion 31 has a ceiling wall 33 that extends in substantially forward and backward directions, side walls 34, 35 that extend down from opposite lateral edges of the ceiling wall 33, a bottom wall 36 that projects from the projecting end of the left side wall 34 of FIG. 4 to substantially face the ceiling wall 33, and an outer wall 37 that projects from the projecting end of the right side wall 34 of FIG. 4 to be outside of the bottom wall 36.

The front end of the ceiling wall 33 is retracted back from the other walls 34, 35, 36 and 37. A tongue projects from the front end of the ceiling wall 33 and is folded back to define a resilient contact piece 38 that faces the ceiling and bottom walls 33 and 36, as shown in FIG. 8. The resilient contact piece 38 has a substantially triangular shape, with a substantially U-shaped fold at the front end, a forward inclined portion behind the U-shaped fold and a backward inclined portion behind the forward-inclined portion. An area that extends from the forward-inclined portion to the backward-inclined portion is embossed toward the bottom wall 36 to form a substantially elliptical bulge 39 that is narrow in forward and backward directions. The peak of the bulge 39 defines a contact 40 for contacting the tab of the mating male terminal fitting. The resilient contact piece 38 is deformed resiliently about the fold and approaches the ceiling wall 33 in response to forces exerted by the tab of the male terminal fitting. The bottom end of the resilient contact piece 38 can contact the inner surface of the ceiling wall 33 during the resilient deformation. Thus, a recess 41 is formed on the ceiling wall 33 for enlarging a degree of resilient deformation of the resilient contact piece 38 and preventing the deformed resilient contact piece 38 from widthwise displacement.

An excessive deformation preventing projection 42 is embossed on the ceiling wall 33 and projects toward the contact 40. The resilient contact piece 38 can engage the excessive deformation preventing projection 42 to prevent deformation of the resilient contact piece 38 beyond its resiliency limit. Further, a receiving portion 43 bulges toward the resilient contact piece 38 at a position on the bottom wall 36 facing the bulge 39 and the locking projection 52. Thus, the tab of the male terminal fitting can be squeezed between the receiving portion 43 and the resilient contact piece 38.

The outer wall 37 is divided into front and rear portions 37*a* and 37*b* by a cut-away 44 formed over substantially the entire width substantially at the longitudinal middle of the outer wall 37, as shown in FIGS. 5 and 8. The lock 13 can enter the cut-away 44 over its entire length when the female terminal fitting 30 is inserted into the cavity 11. Thus, the lock 13 can engage a front cut end surface 44*a* of the cut-away 44. The front cut end surface 44*a* of the cutaway 44 inclines in and up to the back over its entire area. Additionally, the cutaway 44 has a length slightly less than half the length of the outer wall 37 and extends up to the bottom end of the sidewall 35 at the upper side in FIG. 5. A bulge 45 projects from the projecting end of the bottom wall 36 and contacts the bottom cut end surface of the cut-away 44 at the side of the sidewall 35 to hold the bottom wall 36 substantially horizontal. The entire area of the bottom wall 36, except a contact portion of the bulge 45 with the sidewall 35, is slightly lower than the contact portion, thereby increasing a depth of engagement with the lock 13. Additionally, the front portion 37*a* of the outer wall 37 is slightly shorter than the rear portion 37*b* in forward and backward directions.

Figure 6:
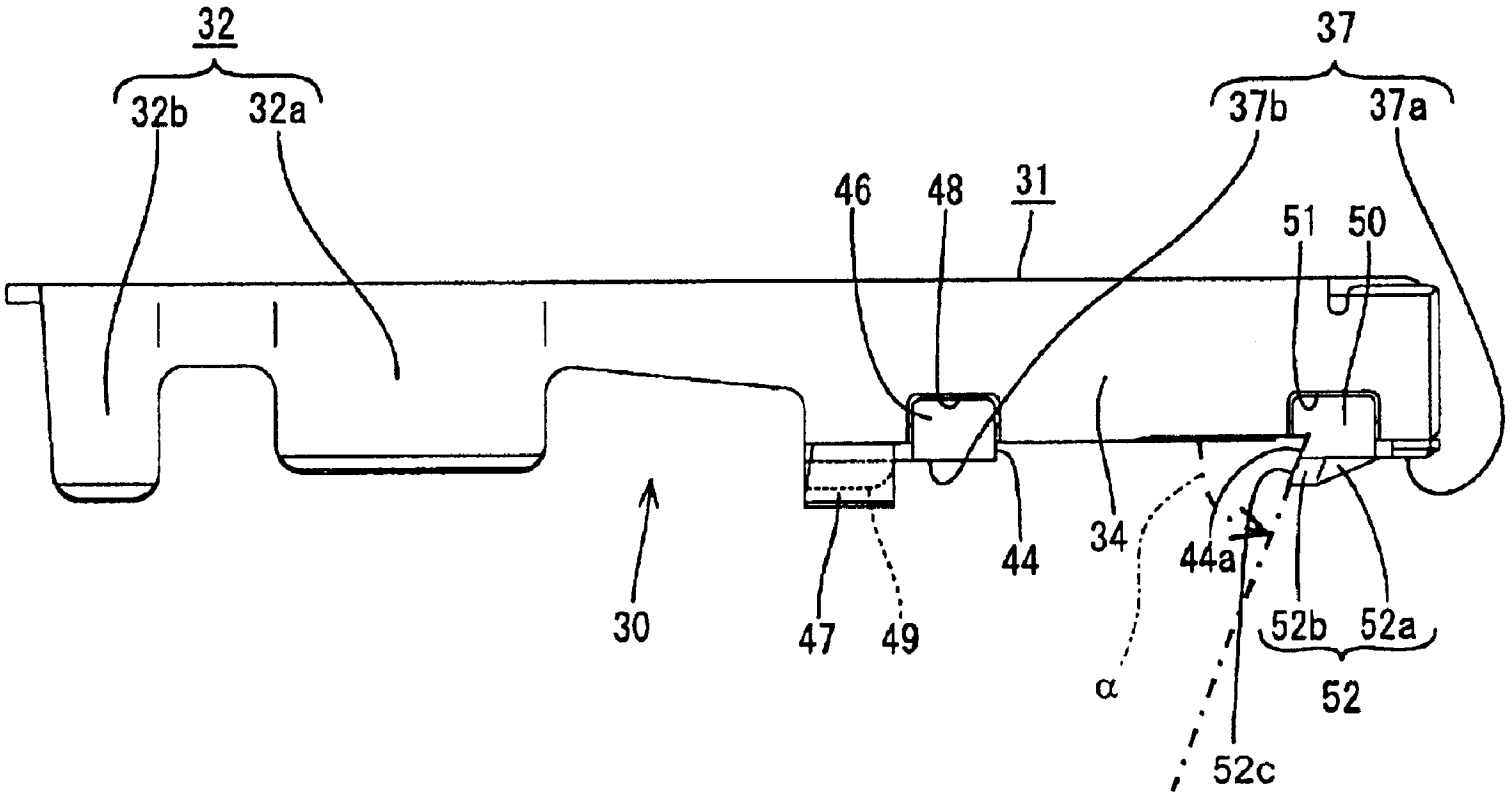
FIG. 6 is a left side view of the female terminal fitting.

An inwardly-bent rear-portion holding piece 46 and an outwardly-bent stabilizer 47 are provided one after the other at the projecting end of the rear portion 37*b* of the outer wall 37, as shown in FIGS. 5 and 6. The rear-portion holding piece 46 fits into a rear-portion holding groove 48 in the side wall 34, as shown in FIG. 6, to prevent the rear portion 37*b* from making loose forward and backward movements. The stabilizer 47 is received in the stabilizer-inserting groove 20 to guide the insertion of the female terminal fitting 30 into the cavity 11. The front end of the rear-portion holding piece 46 and the front end of the rear portion 37*b* are substantially aligned, whereas the rear end of the stabilizer 47 and the rear end of the rear portion 37*b* are substantially aligned. A projection 49 is embossed to project out at the widthwise center of the rear end of the rear portion 37*b*. The projection 49 has a length substantially equal to the length of the stabilizer 47 and contacts the bottom surface of the cavity 11 when the female terminal fitting 30 is inserted into the cavity 11.

A front-portion holding piece 50 is bent toward the ceiling wall 33 at the projecting end of the front portion 37*a* of the outer wall 37. The front-portion holding piece 50 fits into a front-portion holding groove 51 in the side wall 34, as shown in FIG. 6, to prevent the front portion 37*a* from making loose forward and backward movements. The front-portion holding piece 50 projects more backward than the front portion 37*a* of the outer wall 37. The cut-away portion 44 extends into the base end of the front-portion holding piece 50, and the cut end surface 44*a* inclines in and up to the back, as already described. A side end of the lock 13 is engageable with the cut end surface 44*a*.

Figure 7:
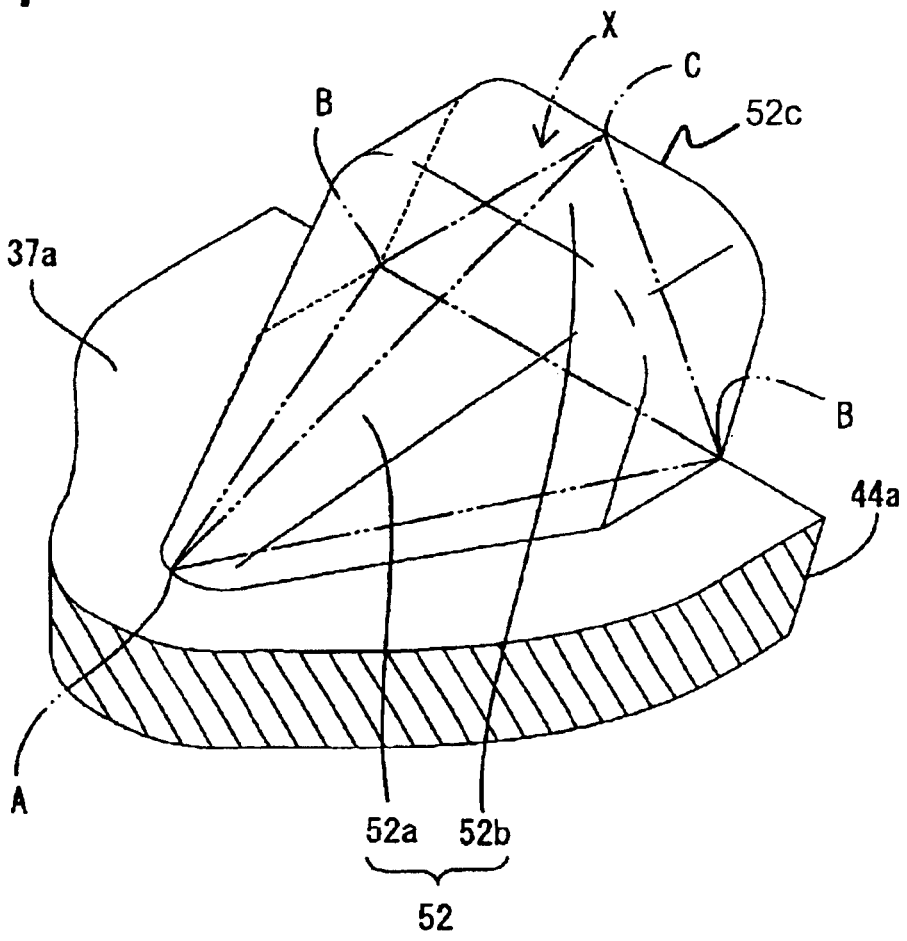
FIG. 7 is an enlarged perspective view showing a locking projection and an imaginary triangular pyramid.

A locking projection 52 is embossed at the rear end of the front portion 37*a* of the outer wall 37 and projects out at a position slightly displaced to the left of the widthwise center, as shown in FIG. 4. The locking projection 52 is engageable with the lock 13. The locking projection 52 has a vertex at its front end and a reduced height and width toward its front end, as shown in FIGS. 5 to 7. More particularly, the locking projection 52 has a pyramid portion 52*a* formed by three slanted surfaces and a substantially rectangular tube portion 52*b* with a substantially constant width and height formed by three side surfaces connected one after the other. The pyramid portion 52*a* of the locking projection 52 is tapered and has its front end slightly rounded, so that the locking projection 52 can be inserted smoothly along the projection-inserting groove 19 in the process of inserting the female terminal fitting 30 into the cavity 11. The substantially tube portion 52*b* of the locking projection 52 projects back substantially along the inclination of the front cut end surface 44*a* of the cut-away 44 and projects more back towards the cut-away 44 than the front portion 37*a* of the outer wall 37. Thus, the locking projection 52 is substantially parallel to the front cut end surface 44*a* and is inclined at an acute angle $\alpha$ to the insertion and withdrawal directions IWD, see FIG. 6.

Figure 9:
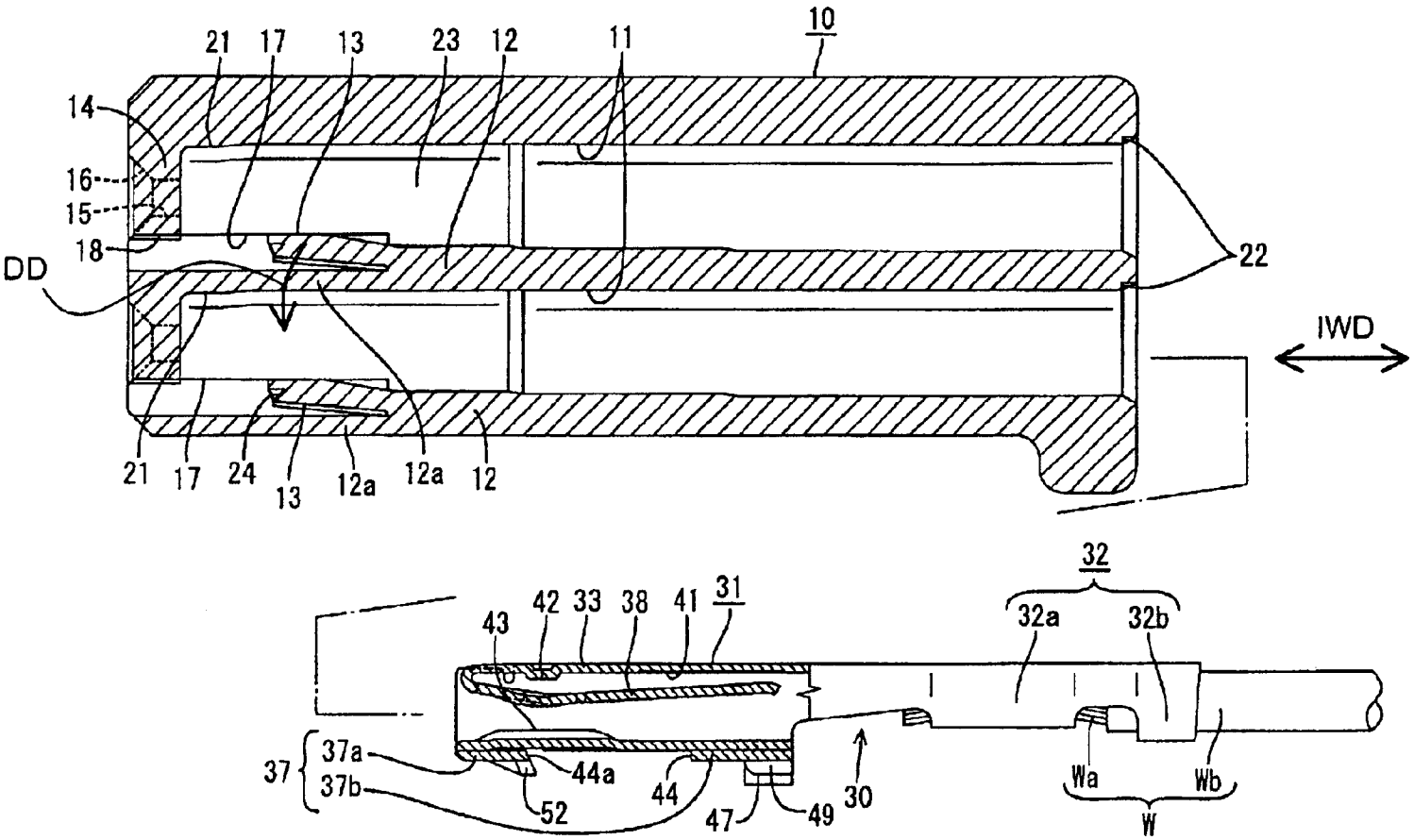
FIG. 9 is a sectional view of the female housing taken along line B—B of FIG. 1 and a sectional view of the female terminal fitting taken along F—F of FIG. 4 before the female terminal fitting is inserted into the female housing.

This locking projection 52 projects substantially the same distance as the projection 49, and is insertable into the projection-inserting groove 19 of the cavity 11. The outward-projecting end of the rectangular tube portion 52*b* of the locking projection 52 reaches a part of the lock 13 below the projection 25 over substantially the entire height range of the front-end surface of the lock 13, thus ensuring a sufficient depth of engagement with the lock 13. The rear end surface 52*c* of the locking projection 52 is a locking surface for engaging the lock 13, and is formed by the front cut end surface 44*a* of the cut-away 44 and is inclined down and to the back. The rear end surfaces of the portions of the front portion 37*a* of the outer wall 37 at opposite sides of the locking projection 52 also are formed by the front cut end surface 44*a* of the cut-away 44 inclined down and to the back for engagement with the lock 13, as shown in FIG. 9.

The locking projection 52 projects more outward than an imaginary triangular pyramid X that has a vertex A at the front end of the locking projection 52, as shown in FIG. 7. The imaginary triangular pyramid X is formed by connecting the vertex A with a pair of base end points B at the rear edge of the front portion 37*a* of the outer wall 37 and an outward projecting end point C substantially at the middle of the rear end 52*c* of the locking projection 52. The outer surfaces of the locking projection 52 project more outward than any side of the imaginary triangular pyramid X, as defined by straight lines connecting the vertex A and the base end points B, a straight line connecting the vertex A and the projecting end point C, and straight lines connecting the base end points B and the projecting end point C. Thus, the inner volume of the locking projection 52 is larger than that of the imaginary triangular pyramid X. More particularly, the locking projection 52 has a substantially trapezoidal shape with three surfaces that have an increasing cross-section towards the back end as seen in the inserting direction of the terminal fitting 30 into the cavity 11 which is larger than the imaginary triangular pyramid X.

A forwardly open fitting groove 53 is formed at a corner between the front portion 37*a* of the outer wall 37 and the right side wall 35 of FIG. 4, which is the corner opposite from the ceiling wall 33 and opposite from the front-portion holding piece 50. The supporting projection 26 at the front end of the cavity 11 is engageable with the fittable groove 53 as the female terminal fitting 30 is inserted into the cavity 11. Thus, the female terminal fitting 30 is supported so as not to move loosely along the vertical direction.

Figure 19:
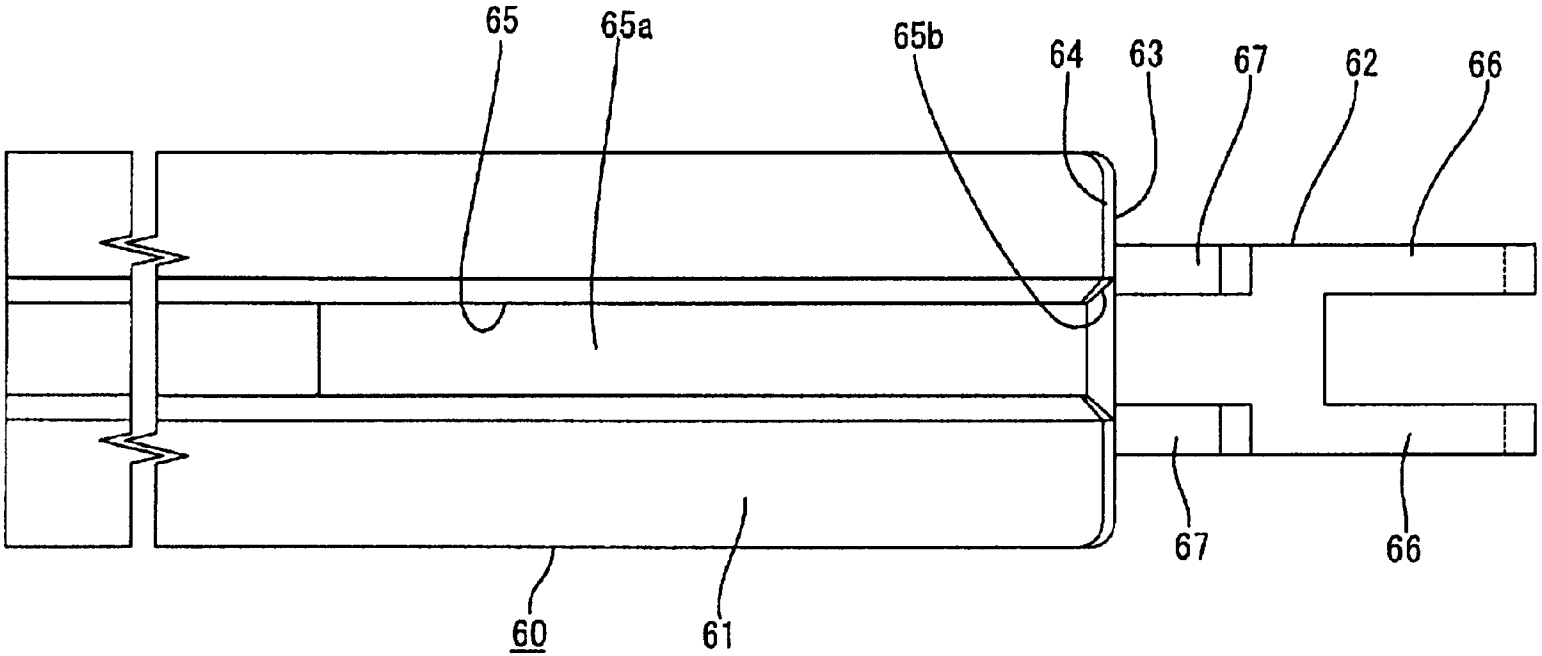
FIG. 19 is a plan view of a disengagement jig.
Figure 20:
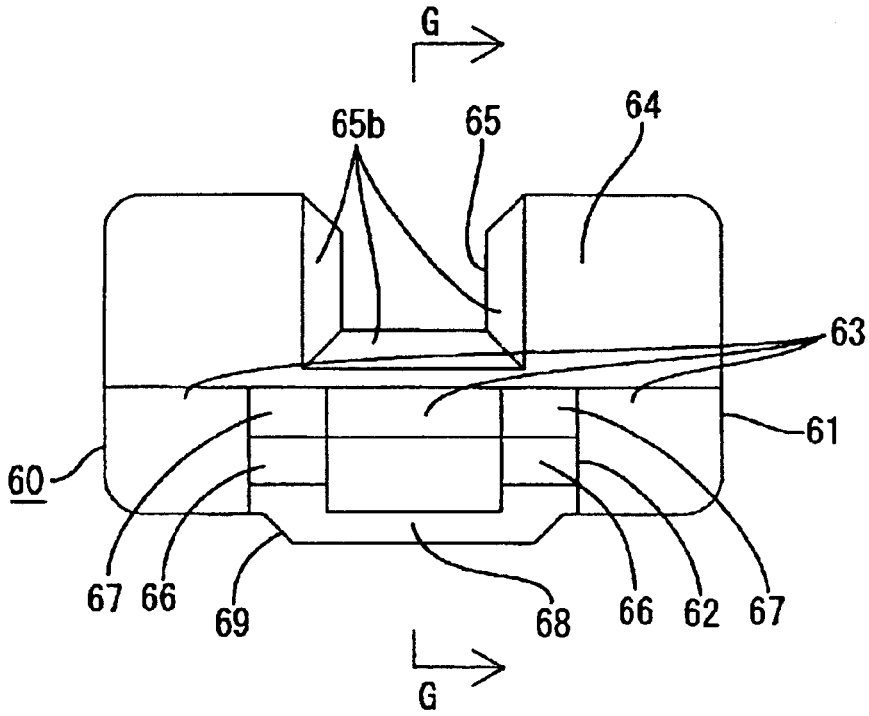
FIG. 20 is a front view of the disengagement jig.
Figure 21:
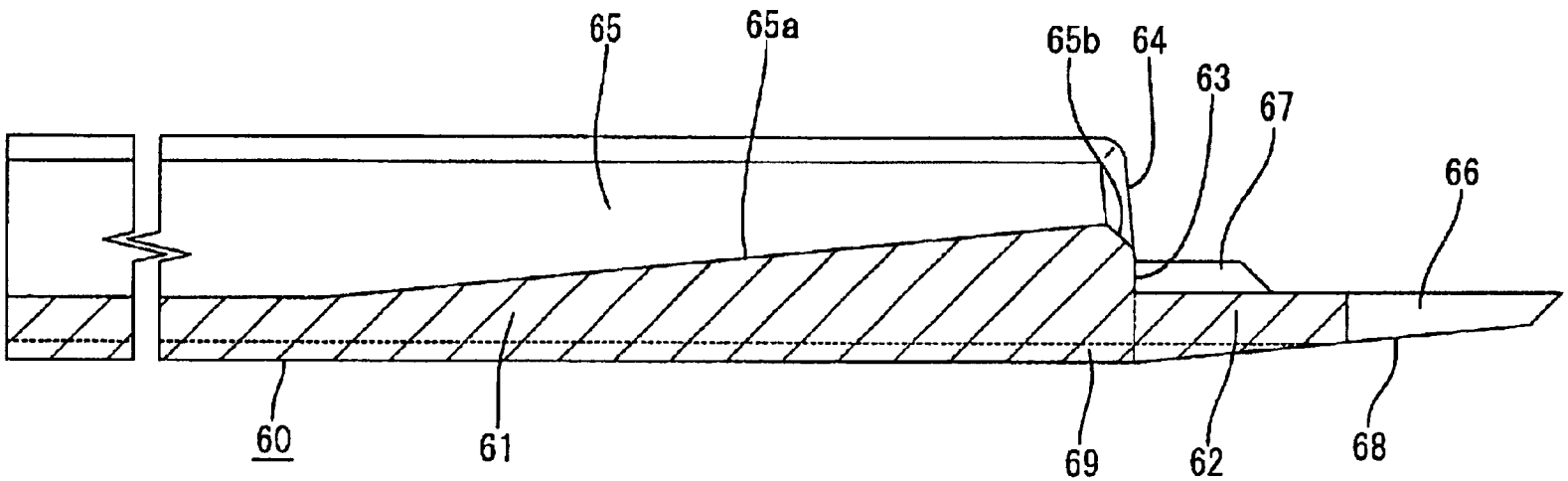
FIG. 21 is a section along G—G of FIG. 20.

A disengagement jig 60, as shown in FIGS. 19 to 21, has a long narrow grip 61 to be manipulated by an operator. A disengaging portion 62 is at the leading end of the grip 61 and is adapted to operate the lock 13, an entrance restricting surface 63 and an inclination restricting surface 64. The grip 61 is substantially in the form of a long narrow block, and a receiving recess 65 is formed along forward and backward directions substantially in the widthwise center of the upper surface of the grip 61.

The disengaging portion 62 is narrower than the grip 61 and has a forked leading end that defines a pair of operation arms 66. The operation arms 66 are spaced apart slightly more than the width of the locking projection 52 of the female terminal fitting 30 and equal the space between the maneuverable recesses 24 of the lock 13. Thus, leading ends of the operation arms 66 can press the maneuverable recesses 24 down in the deforming direction DD of the lock 13 and away from the terminal fitting 30 without interfering with the locking projection 52. Tapered surfaces are formed at the leading ends of the operation arms 66 and have an inclination substantially matching the inclination of the bottom surfaces of the maneuverable recesses 24. Two long narrow posture-correcting portions 67 project at opposite sides of the upper surface of the base end of the disengaging portion 62, and have slanted front surfaces. The space between the posture correcting portions 67 substantially equals the space between the operation arms 66 to avoid interference with the projection 18 in the mold-removal hole 17. The posture correcting portions 67 can contact the upper edge of the mold-removal hole 17. Thus, the inserting posture of the disengagement jig 60 can be corrected into a substantially horizontal posture. The posture correcting portions 67 can pivot the entire disengagement jig 60 with the upper edge of the mold-removal hole 17 as a support. An escaping slanted surface 68 is formed on substantially the entire bottom surface of the disengaging portion 62 including the two operation arms 66 and slopes up toward the leading ends of the operation arms 66. The escaping slanted surface 68 forms a specified clearance between the disengaging portion 62 and the inner surface of the lowered portion 12*a* of the bottom wall 12 when the disengaging portion 62 is inserted into the mold-removal hole 17 (see FIG. 23), thereby permitting a leverage action of the disengagement jig 60. A thickened portion 69 bulges down along forward and backward directions at a part of the bottom surface of the disengagement jig 60 that extends from an intermediate position of the escaping slanted surface 68. The width of the thickened portion 69 is set so that the thickened portion 69 can be inserted between the two bulging portions 12*c* (see FIG. 26).

The entrance-restricting surface 63 is formed on lower part of the leading end surface of the grip 61 in area below the tops of the posture correcting portions 67. The entrance-restricting surface 63 is substantially vertical and restricts the depth of insertion of the disengaging portion 62 into the mold-removal hole 17. The inclination-restricting surface 64 is on an upper part of the leading end surface of the grip 61 and its upper end and slopes back with respect to an inserting direction into the mold-removal hole 17. The inclination-restricting surface 64 restricts pivotal movement of the disengagement jig 60 by contacting the front surface of the female housing 10 when the disengagement jig 60 is operated as a lever, thereby restricting a degree of deformation of the lock 13. It should be noted that the degree of deformation of the lock 13 is set to be a necessary and minimum to disengage the lock 13 from the female terminal fitting 30 and below a resiliency limit of the lock 13.

Figure 27:
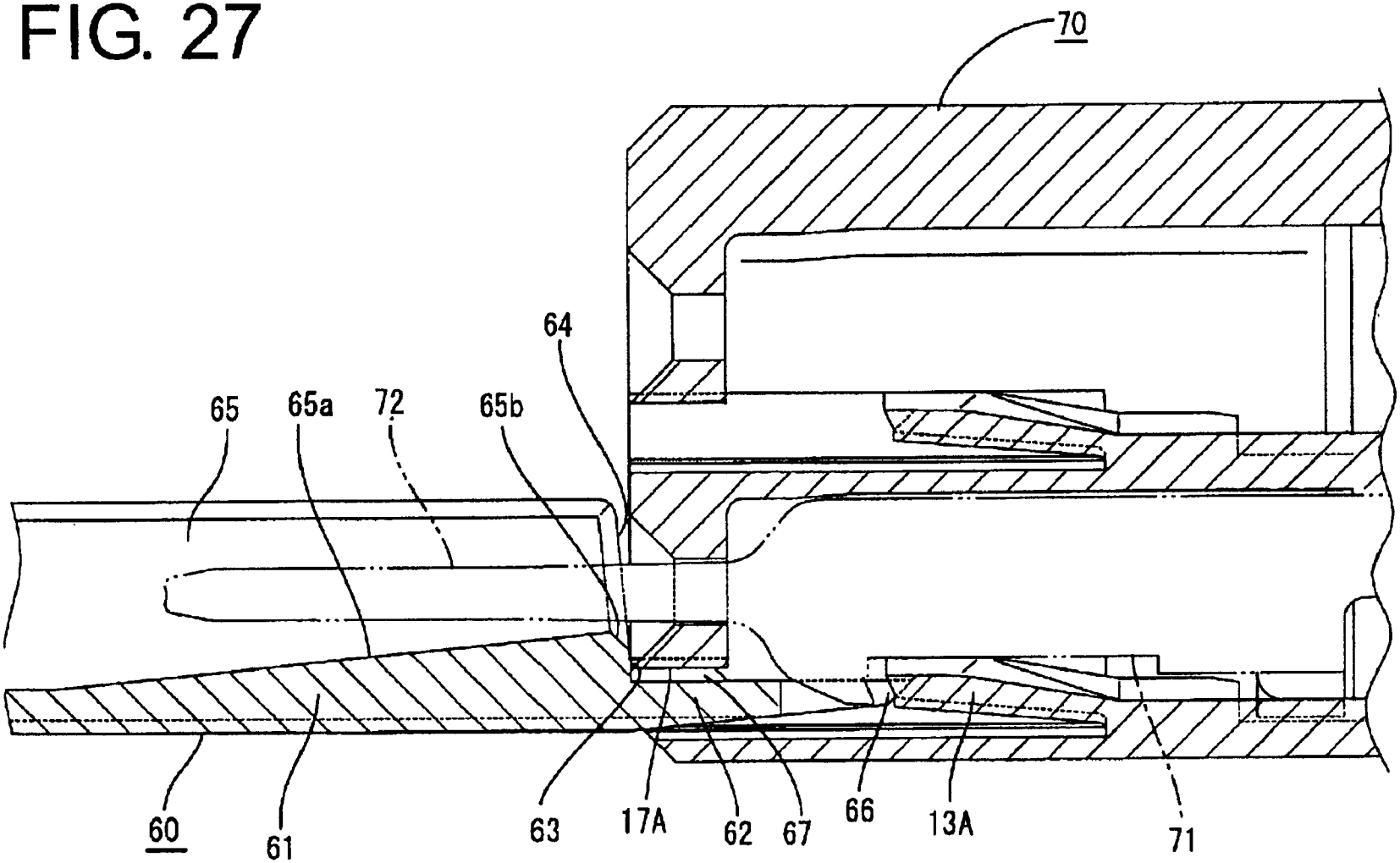
FIG. 27 is a side view in section showing a state where the disengagement jig is inserted into a mold-removal hole when the disengagement jig is used for a male connector.

This disengagement jig 60 can be used for the above-described female connector and also for a male connector. More particularly, as shown in FIG. 27, a male connector has a housing 70 that accommodates a male terminal fitting 71. The male terminal fitting 71 has a tab 72 that projects from the front surface of the male housing 70. Interference of a disengagement jig and a tab has been problematic with the prior art disengagement jig. However, the receiving recess 65 is formed in the jig 70 to receive the tab 72, and a bottom surface 65*a* thereof slopes down to the back with respect to the inserting direction. Thus, interference of the disengagement jig 60 with the tab 72 can be avoided even when the disengagement jig 60 is operated as a lever. A beveled portion 65*b* is formed at the entrance edge of the receiving recess 65 for the tab 72 for guiding the insertion of the tab 72.

As shown in FIGS. 8 to 11, the barrel 32 of the female terminal fitting 30 is crimped, bent or folded into connection with the wire W and then the female terminal fitting 30 is inserted into the cavity 11 from behind. An attempt could be made to insert the female terminal fitting 30 upside down. However, the upward-facing stabilizer 47 will contact the restricting portion 22 at the peripheral edge of the rear end of the cavity 11, thereby hindering the insertion of the female terminal fitting 30. In this way, an upside-down insertion of the female terminal fitting 30 is prevented.

Figure 12:
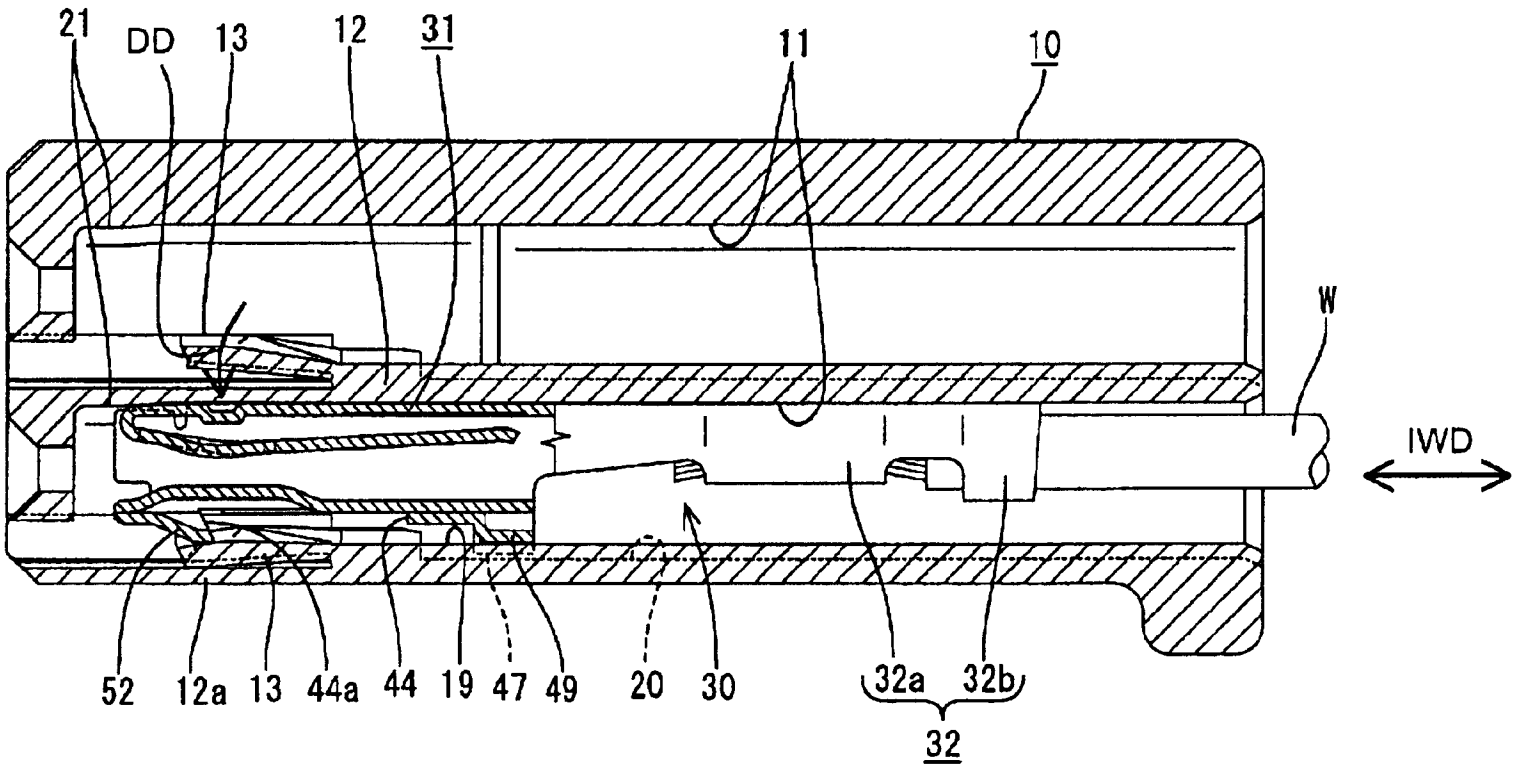
FIG. 12 is a side view in section (the female housing is shown by the section along A—A of FIG. 1 and the female terminal fitting is shown by the section along E—E of FIG. 4) showing an intermediate stage of insertion of the female terminal fitting into the female housing.
Figure 13:
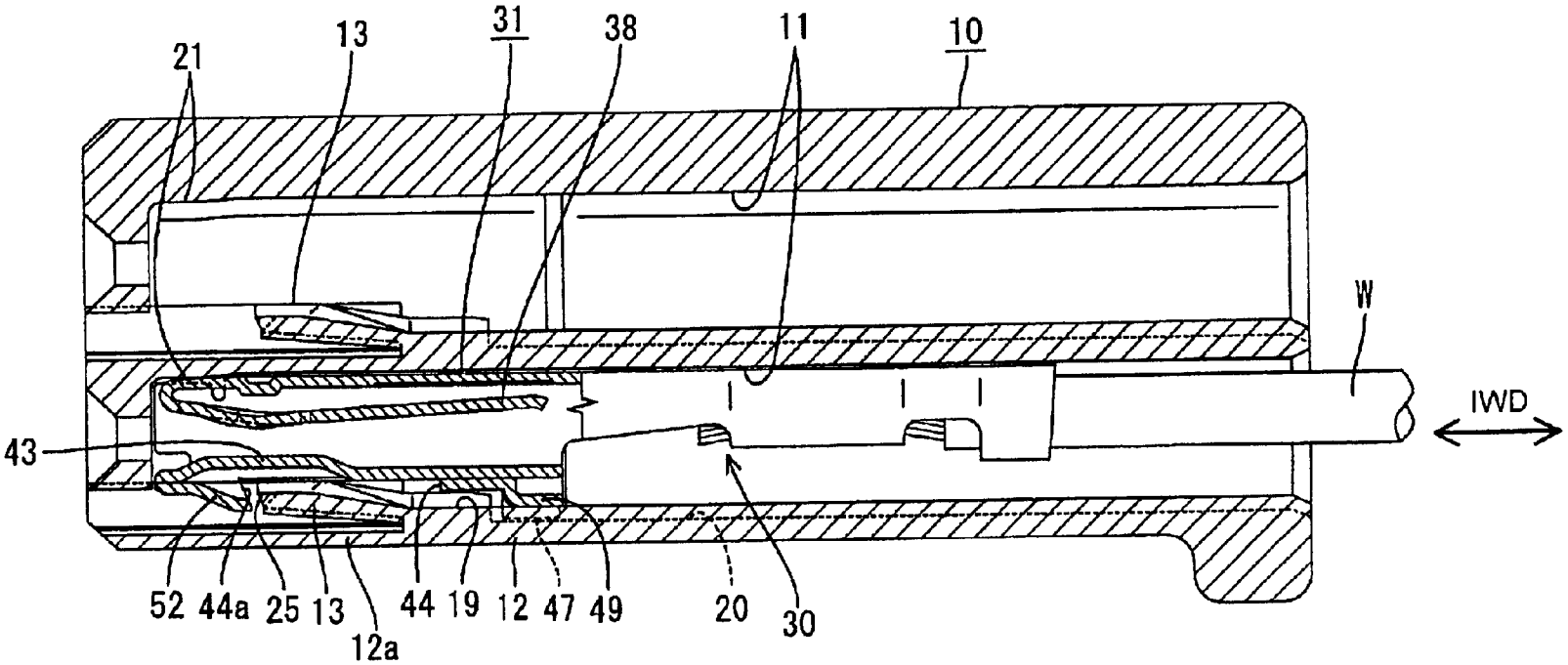
FIG. 13 is a side view in section (the female housing is shown by the section along A—A of FIG. 1 and the female terminal fitting is shown by the section along E—E of FIG. 4) showing a state where the female terminal fitting is inserted in the female housing.
Figure 14:
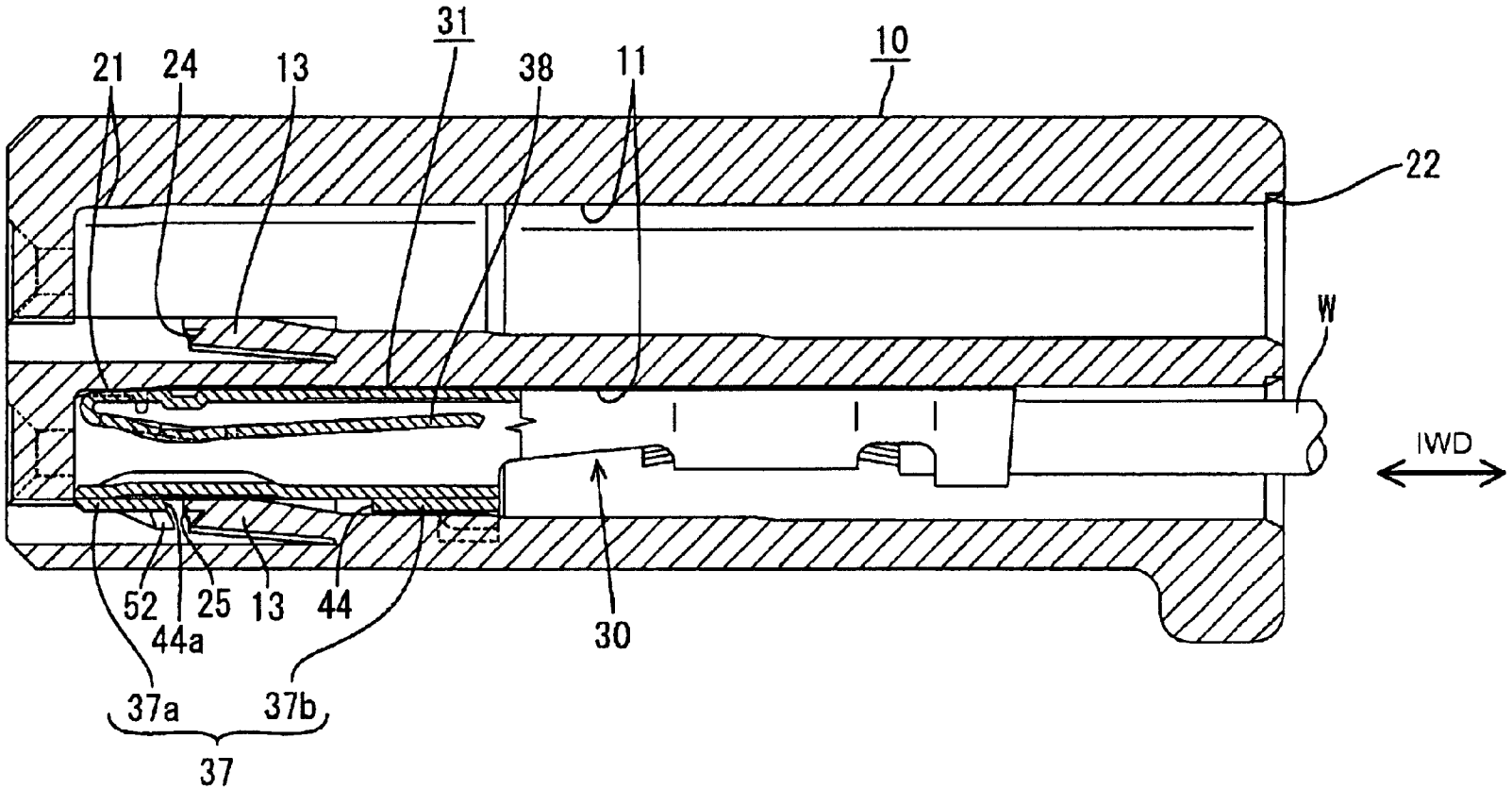
FIG. 14 is a side view in section (the female housing is shown by the section along B—B of FIG. 1 and the female terminal fitting is shown by the section along F—F of FIG. 4) showing the state where the female terminal fitting is inserted in the female housing.

The locking projection 52 is introduced into the projection-inserting groove 19 when the properly oriented female terminal fitting 30 is inserted into the cavity 11. The projection 49 and the stabilizer 47 then are introduced into the projection-inserting groove 19 and the stabilizer-inserting groove 20, respectively. Thus, the female terminal fitting 30 can be inserted smoothly and will not shake along vertical and transverse directions. Sufficient insertion of the female terminal fitting 30 causes the locking projection 52 to deform the lock 13 down in the deformation direction DD and into the deformation permitting space S, as shown in FIG. 12. The lock 13 is deformed in the deformation direction DD to a maximum degree when the front part 13*a* is pressed by the locking projection 52. The locking projection 52 has a substantially pyramidal shape with a vertex at the front end, and therefore is inserted smoothly along the projection-inserting groove 19 and can smoothly press the lock 13.

Figure 15:
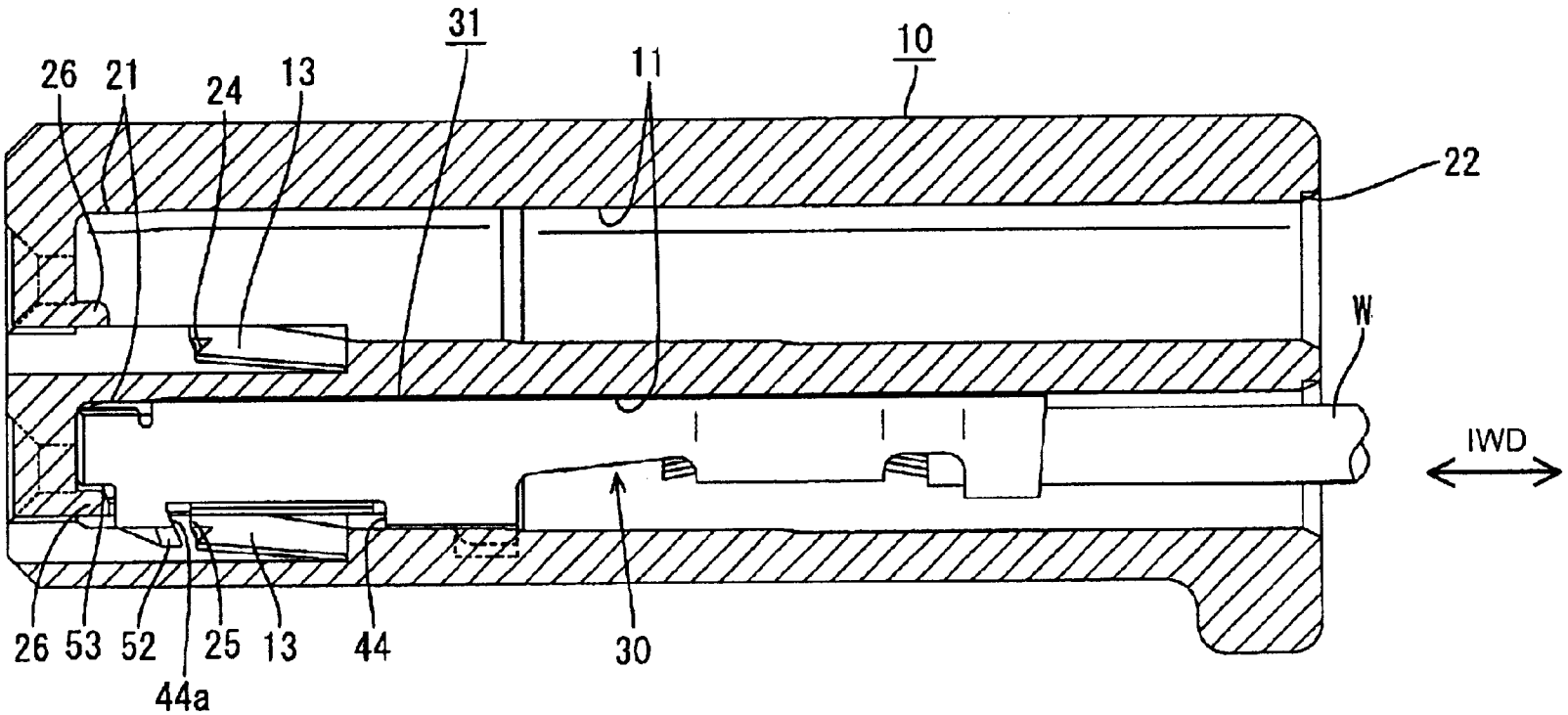
FIG. 15 is a side view in section (the female housing is shown by the section along C—C of FIG. 1 and the female terminal fitting is shown by a right side view) showing the state where the female terminal fitting is inserted in the female housing.
Figure 16:
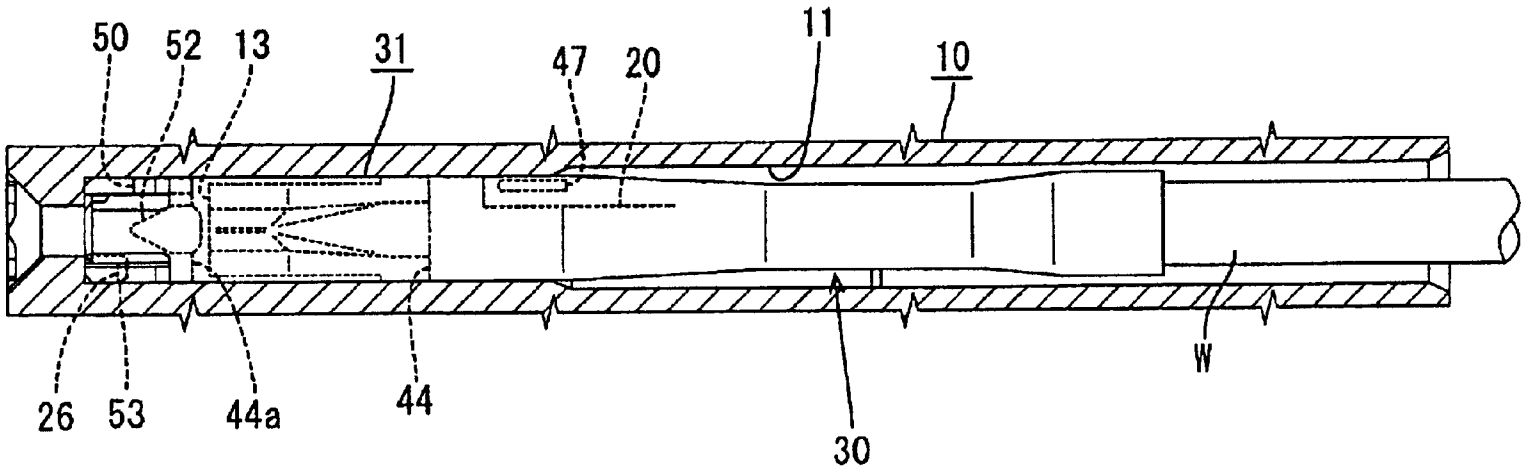
FIG. 16 is a side view in section (the female housing is shown by the section along D—D of FIG. 1 and the female terminal fitting is shown by a plan side view) showing the state where the female terminal fitting is inserted in the female housing.
Figure 17:
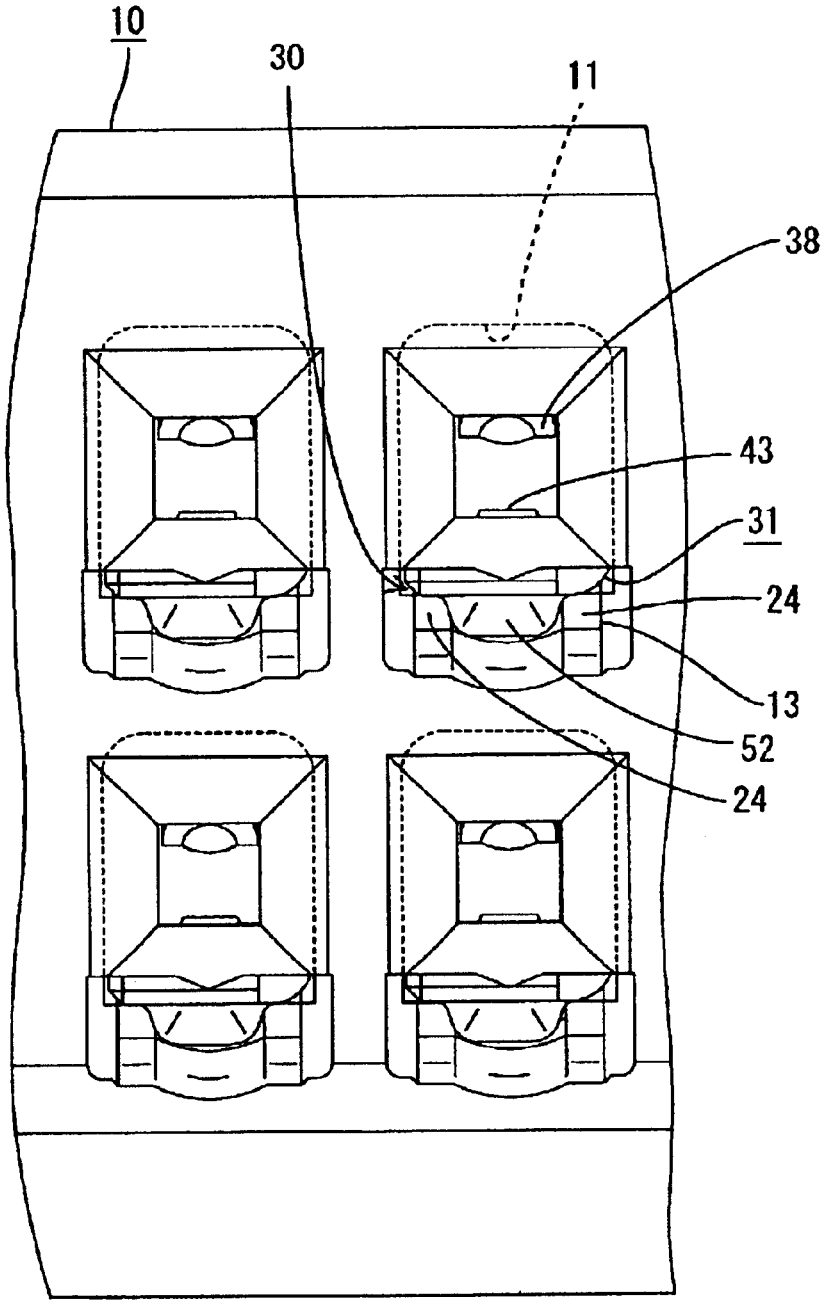
FIG. 17 is a front view showing a state where the female terminal fittings are inserted in the female housing.

The locking projection 52 moves beyond the lock 13 as the female terminal fitting 30 is inserted to a proper depth in the cavity 11. Thus, the lock 13 is restored resiliently to enter the cut-away portion 44 and lock the female terminal fitting 30, as shown in FIGS. 13 to 16. At this time, the projecting portion 25 of the lock 13 projects along the inclination of the cut end surface 44*a* and enters the inside of the locking projection 52. The front end of the main portion 31 is pushed down by the jutting portion 21 on the ceiling surface of the cavity 11 and displaces towards the lock 13. Thus, the depth of engagement of the lock 13 with the female terminal fitting 30 is increased. Further, vertical inclination of the female terminal fitting 30 is prevented by the engagement of the supporting projection 26 with the fittable groove 53, as shown in FIG. 15. The locking projection 52 is displaced from both maneuverable recesses 24 of the lock 13 along the widthwise direction and is exposed forward to the outside together with the maneuverable recesses 24, as shown in FIG. 17.

The front cut end surface 44*a* of the cut-away portion 44 extends to the front portion 37*a* of the outer wall 37, including the locking projection 52 and the front-portion holding piece 50. Thus, the front-end surface 44*a* is formed over substantially the substantially entire width of the female terminal fitting 30, as shown in FIGS. 13 to 16. As a result, the female terminal fitting 30 is held with a strong locking force and will not come out of the cavity 11. Further, the locking force is even stronger because the front cut end surface 44*a* of the cutaway portion 44 is inclined.

The locking projection 52 of the female terminal fitting 30 contacts the front-end surface of the lock 13 in the above-described locked state. There is a possibility that a force will act on the female terminal fitting 30 via the wire W to pull the female terminal fitting 30 back, and will cause the locking projection 52 to bite in the lock 13. If this occurs, part of the lock 13 may be scraped off and enter the inner space of the locking projection 52. However, the volume of the inner space of the locking projection 52 is larger than the inner volume of the imaginary triangular pyramid X shown in FIG. 7. Thus, a larger amount of the material of the lock 13 is permitted to enter the inside of the locking projection 52 at the time of biting. Accordingly, a force necessary to pull the female terminal fitting 30 back while causing the lock 13 to bite in the locking projection 52, i.e. a force to lock the female terminal fitting 30, is increased. Hence, the female terminal fitting 30 can be held strongly.

Figure 18:
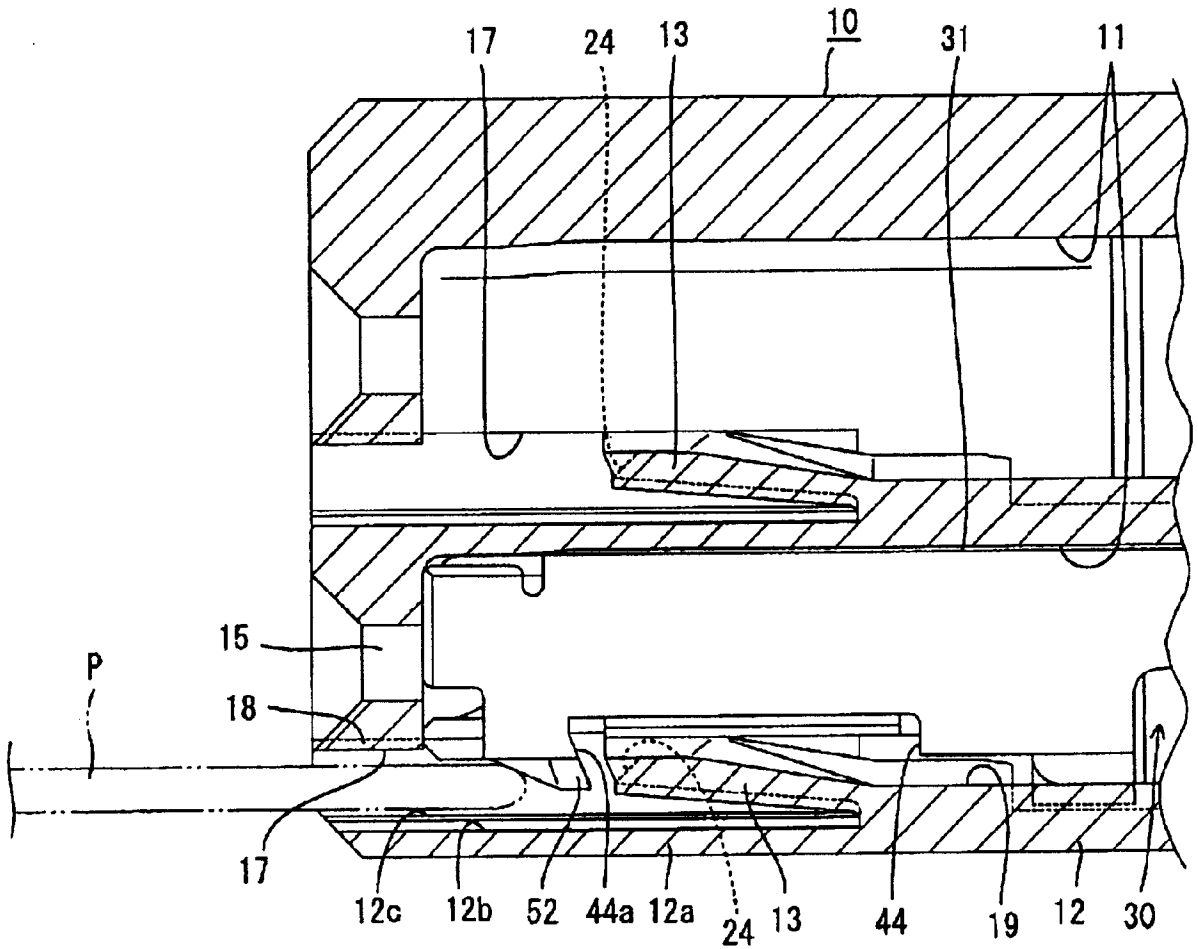
FIG. 18 is a side view in section (the female housing is shown by the section along C—C of FIG. 1 and the female terminal fitting is shown by the right side view) showing the state where an electrical connection test is conducted using an electrical connection probe.

An electrical connection test may be conducted for the female terminal fittings 30 in the cavities 11 of the female housing 10. The test is carried out by inserting an electrical connection probe P substantially horizontally and straight into the mold-removal hole 17 from the front of the female housing 10, as shown in FIG. 18. Thus, the leading end of the electrical connection probe 17 contacts the front pyramidal portion 52*a* of the locking projection 52 exposed to the mold-removal hole 17. In this way, the electrical connection test can be conducted for the female terminal fitting 30.

Figure 22:
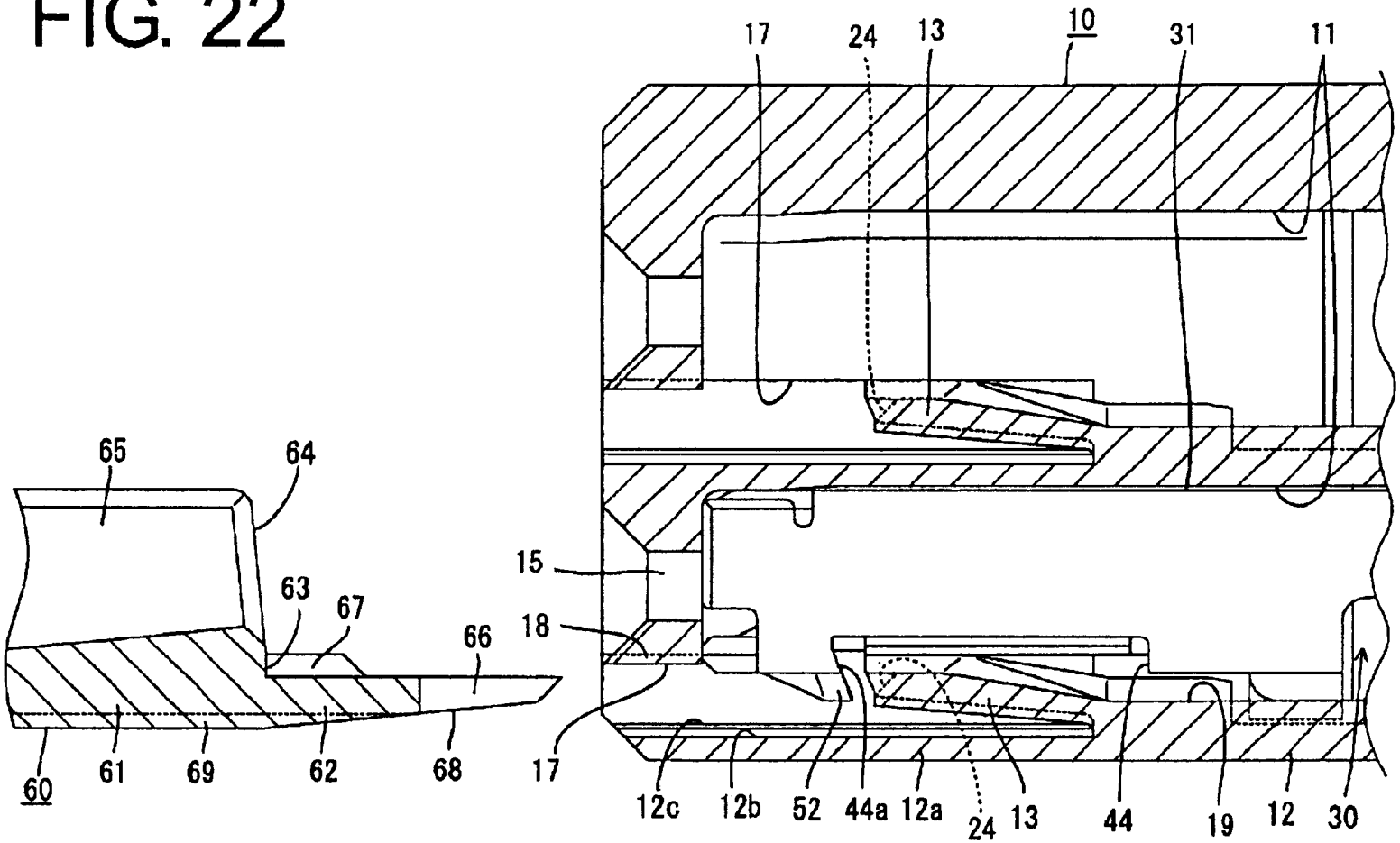
FIG. 22 is a side view in section (the female housing is shown by the section along A—A of FIG. 1, the female terminal fitting is shown by the right side view, and the disengagement jig is shown by the section along G.G of FIG. 20) showing a state before the disengagement jig is inserted into a mold-removal hole.
Figure 23:
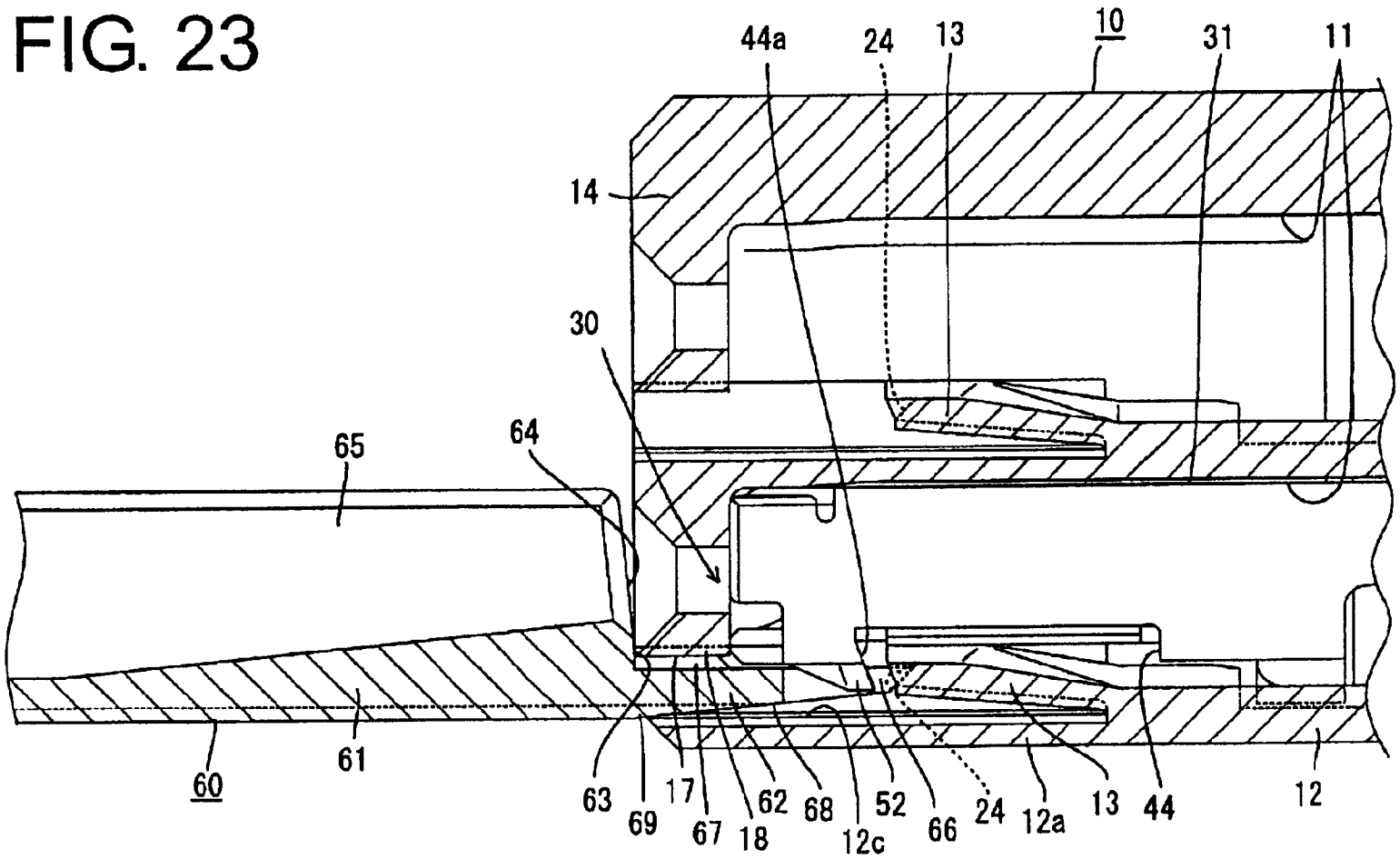
FIG. 23 is a side view in section (the female housing is shown by the section along A—A of FIG. 1, the female terminal fitting is shown by the right side view, and the disengagement jig is shown by the section along G.G of FIG. 20) showing a state where operation arms are inserted into maneuverable recesses.

The female terminal fitting 30 may have to be detached from the female housing 10 for maintenance or other reason. In such a case, the leading ends of the two operation arms 66 are pushed into the mold-removal hole 17 by holding the grip 61 of the disengagement jig 60 as shown in FIG. 22. During the pushing process, the posture correcting portions 67 are held in sliding contact with the upper edge of the mold-removal hole 17. Thus, the inserting posture of the disengagement jig 60 is substantially horizontal (see FIG. 26). Further pushing of the disengagement jig 60 is hindered when the entrance restricting surface 63 contacts the front surface of the female housing 10, as shown in FIG. 23. At this time, the leading ends of the operation arms 66 enter the corresponding maneuverable recesses 24, and the slanted surfaces of both sides are held substantially in contact with each other. In this state, clearances are defined between the escaping slanted surface 68 and the lowered portion 12*a* of the bottom wall 12 and between the inclination-restricting surface 64 and the front-end of the female housing 10.

Figure 24:
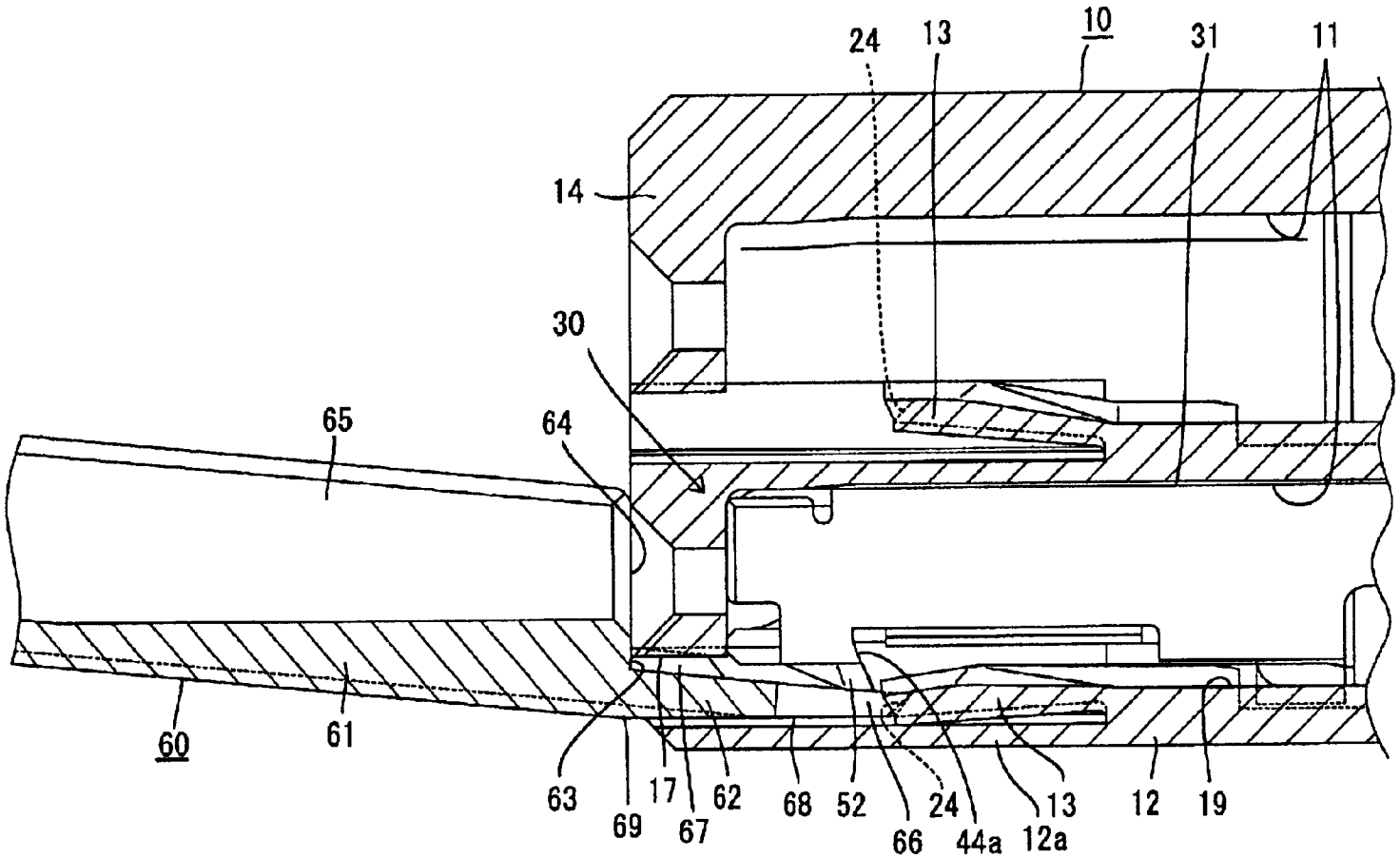
FIG. 24 is a side view in section (the female housing is shown by the section along A—A of FIG. 1, the female terminal fitting is shown by the right side view, and the disengagement jig is shown by the section along G.G of FIG. 20) showing a state where a locking portion is resiliently deformed by the leverage action.
Figure 25:
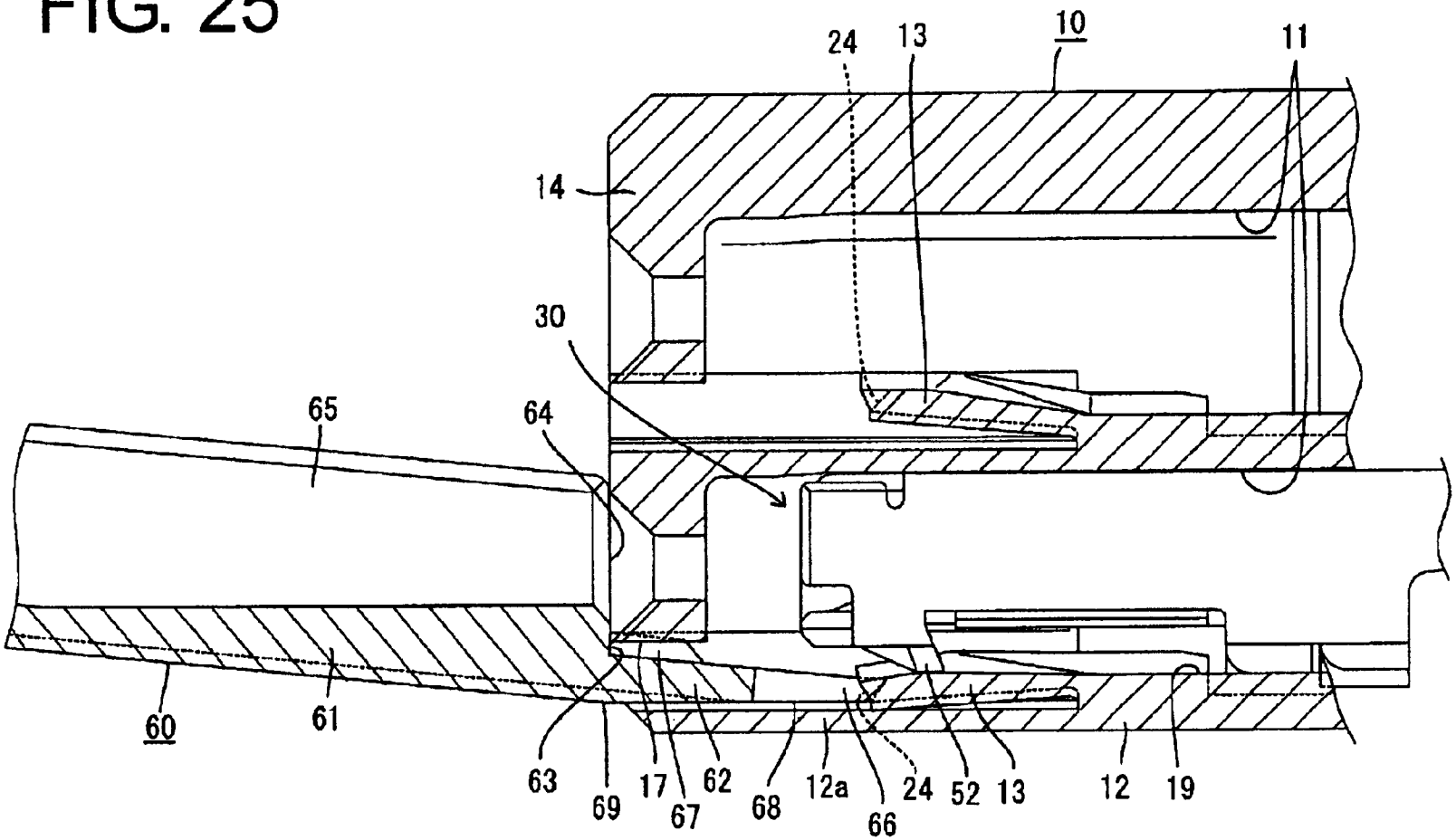
FIG. 25 is a side view in section (the female housing is shown by the section along A—A of FIG. 1, the female terminal fitting is shown by the right side view, and the disengagement jig is shown by the section along G.G of FIG. 20) showing an intermediate stage of the withdrawal of the female terminal fitting.
Figure 26:
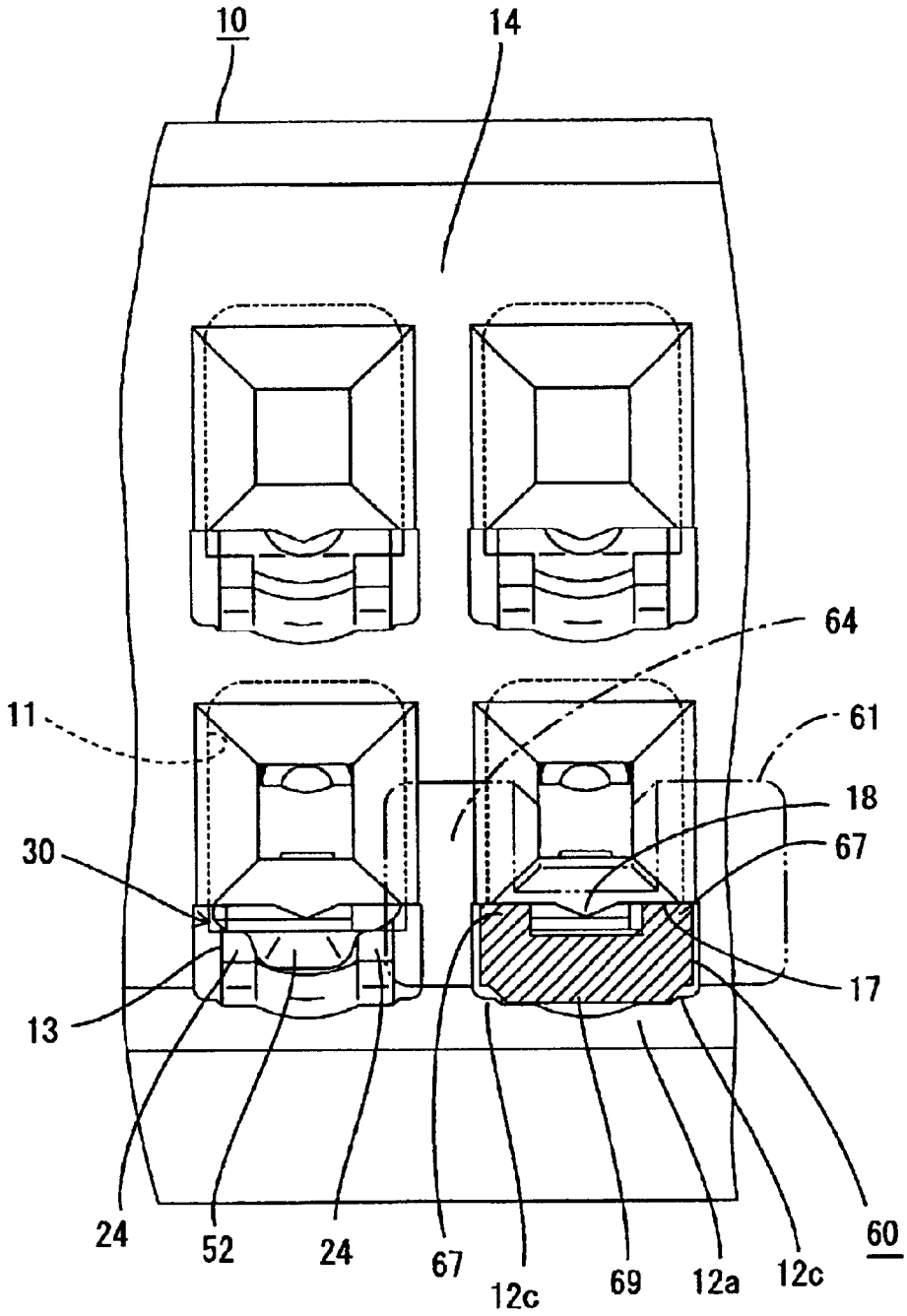
FIG. 26 is a section along H—H of FIG. 23.

The disengagement jig 60 is operated as a lever and is pivoted by lifting the grip 61. As a result, the base ends of the posture correcting portions 67 contact the upper edge of the mold-removal hole 17 and function as pivoting points. The disengagement jig 60 is inclined, as shown in FIG. 24, until the inclination restricting surface 64 contacts the front end surface of the female housing 10 (see FIG. 26). At this time, the escaping slanted surface 68 contacts the lowered portion 12*a* of the bottom wall 12. Then, the two operation arms 66 push the two maneuverable recesses 24 down to deform the lock 13 in the deformation direction DD into the deformation permitting space S. In this way, the lock 13 undergoes a minimum resilient deformation necessary to be disengaged from the female terminal fitting 30. Thus, the female terminal fitting 30 can be pulled back and withdrawn, as shown in FIG. 25.

Figure 28:
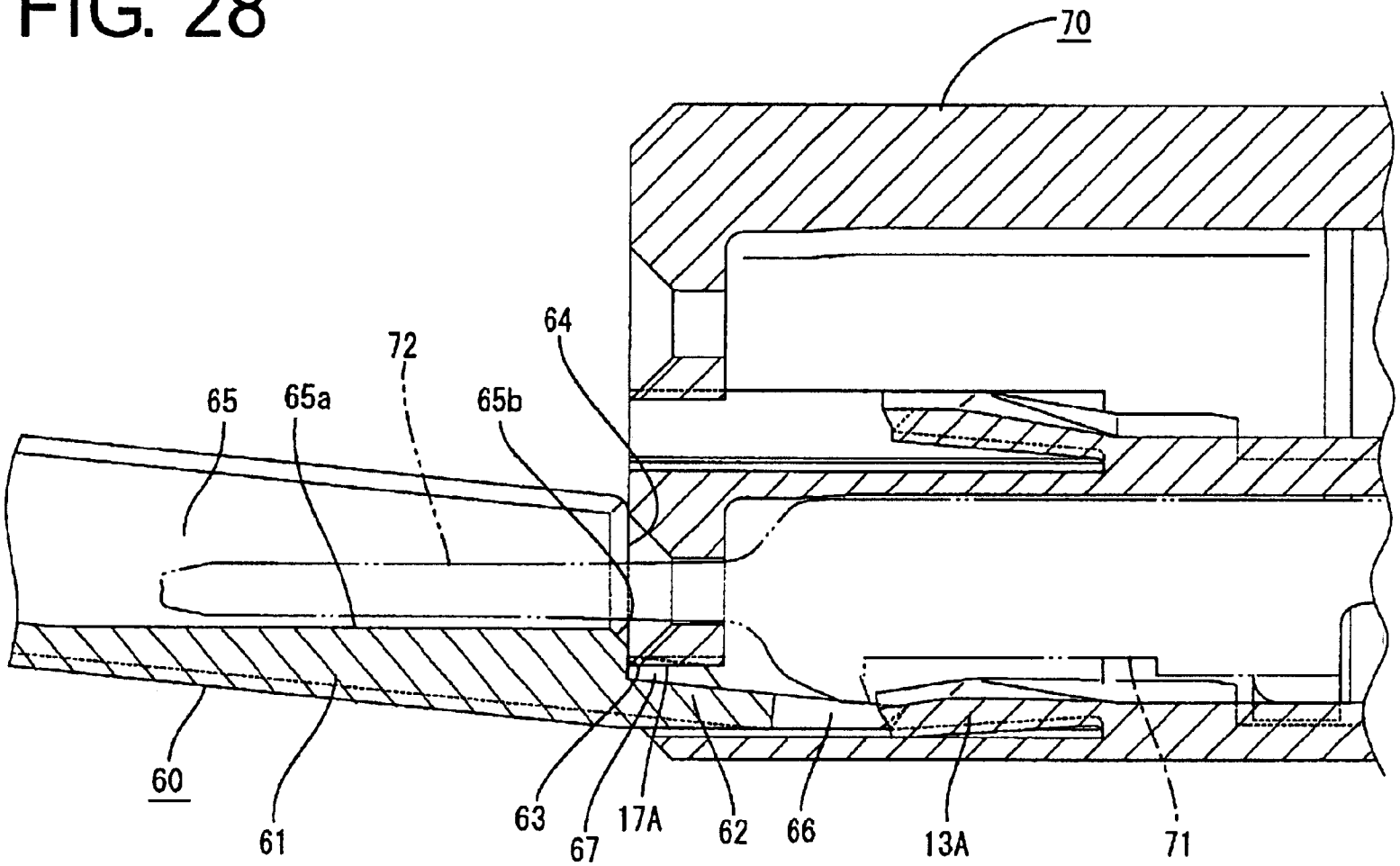
FIG. 28 is a side view in section showing a state of the leverage action when the disengagement jig is used for the male connector.
Figure 29:
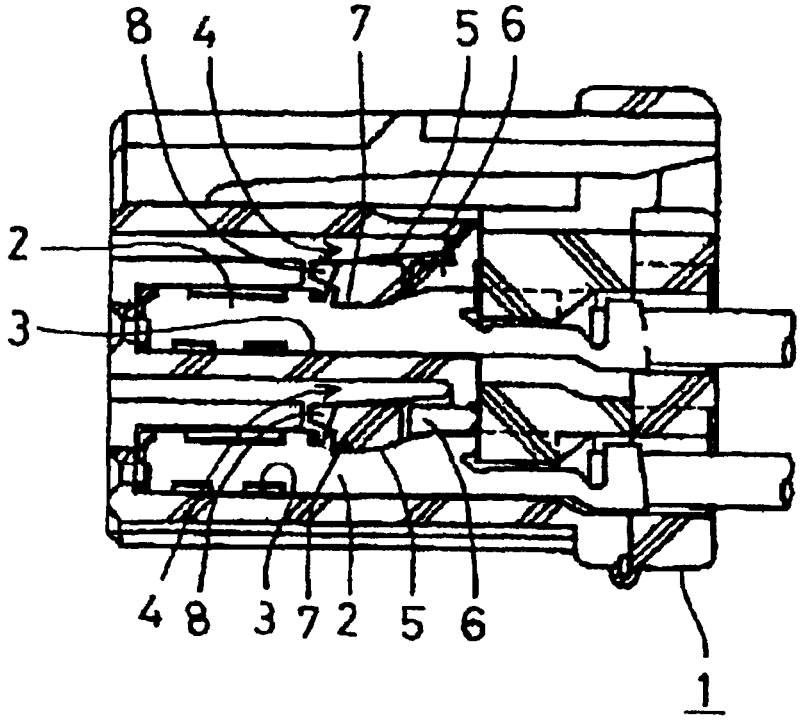
FIG. 29 PRIOR ART
FIG. 29 is a section of a prior art connector.

The male terminal fitting 71 also can be withdrawn from the male connector using the disengagement jig 60 (see FIGS. 27 and 28). Specifically, the disengaging portion 62 is inserted into a mold-removal hole 17A, as described above, so that the tab 72 of the male terminal fitting 71 projecting from the front-end of the male housing 70 is received in the receiving recess 65. The bottom surface 65*a* of the receiving recess 65 slopes down towards the back and in a direction to escape the tab 72 when the disengagement jig 60 is pivoted. Thus, a specified clearance is defined between the bottom surface 65*a* and the leading end of the tab 72 and an interference with the tab 72 can be avoided by the presence of the clearance when the disengagement jig 60 is pivoted to deform the lock 13A. Therefore, the disengagement jig 60 can be used for both female and male connectors.

As described above, the maneuverable recesses 24, which are maneuverable by the disengagement jig 60, are more toward the base end of the lock 13 than a locking surface in the front of the lock 13. Thus, the height of the deformation permitting spaces S for the locks 13 in the female housing 10 need not be larger than the degree of deformation of the locking surface of the lock 13 during the deformation in the deformation direction DD. In addition, the maneuverable recesses 24 are within the width range of the locking surface engageable with the female terminal fitting 30 in the front surface of the lock 13. Therefore, the cavity 11 need not be extended in widthwise direction, and the connector can be miniaturized with respect to height and width directions.

Two maneuverable recesses 24 are arranged along the widthwise direction in the lock 13. Thus, the lock 13 is prevented from undergoing a twisting deformation when being disengaged and, therefore, can be deformed resiliently in the deformation direction DD while being held substantially straight.

The inclination-restricting surface 64 is formed on the leading end of the grip 61 of the disengagement jig 60 to restrict the inclination range of the leverage action by contacting the front surface of the female housing 30 upon effecting the leverage action. Thus, the degree of deformation of the lock 13 can be restricted and, as a result, the locking portion is prevented from undergoing an excessive resilient deformation.

The grip 61 of the disengagement jig 60 has the receiving recess 65, and the tab 72 of the male terminal fitting 71 that projects from the front of the male housing 70 can be received in the receiving recess 65 when the disengaging portion 62 is inserted into the mold-removal hole 17A. The bottom surface 65*a* of the receiving recess 65 slopes down toward the back with respect to the inserting direction into the mold-removal hole 17A. Hence, an escaping portion is provided to avoid interference with the tab 72 received in the receiving recess 65 when the grip 61 is operated. Therefore, the disengagement jig 60 can be used for both male and female connectors.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although two maneuverable recesses are provided along widthwise directions in the foregoing embodiment, an embodiment in which one, three or more maneuverable recesses are provided also is embraced by the invention.

The maneuverable recesses are provided in the locks of the female connector in the foregoing embodiment. However, the invention is similarly applicable to the male connector. Further, although the locks supported at one end are shown in the foregoing embodiment, the invention is also applicable to locks supported at both ends, thereby having deformation supporting points at both front and rear ends.

The disengagement jig causes the lock to deform by the leverage action thereof in the foregoing embodiment. However, a disengagement jig operable along the deforming direction of the locking portion while holding the grip and the disengaging portion horizontal also is embraced by the invention.

Although the disengagement jig having the inclination restricting surface for restricting the inclination range of the leverage action and the receiving recess for receiving the tab of the male terminal fitting is shown in the foregoing embodiment, a disengagement jig having either the inclination restricting surface or the receiving recess also is embraced by the invention.

Although the leading end of the disengaging portion is forked in the foregoing embodiment, the disengaging portion can take any other shape.

What is claimed is:

1. A connector, comprising a housing with opposite front and rear ends, at least one cavity extending between the front and rear ends of the housing for receiving a terminal fitting from behind, a resilient deformable lock projecting forward in the cavity and a deformation permitting space adjacent the lock, the lock being resiliently deformed into the deformation permitting space as the terminal fitting is inserted into the cavity and being resiliently restored after insertion of the terminal fitting to engage and lock the terminal fitting, wherein the lock has a locking surface for engaging the terminal fitting and a maneuverable recess at a position on a leading surface of the lock spaced from the terminal fitting, the maneuverable recess extending into the leading surface of the lock to a position rearward of the locking surface and located within a width range of the locking surface of the lock for maintaining small cross sectional dimensions for the cavity.

2. The connector of claim 1, wherein the maneuverable recess is between the deformation permitting space and the locking surface.

3. The connector of claim 1, wherein two maneuverable recesses are arranged along a widthwise direction.

4. The connector of claim 1, wherein the maneuverable recess is exposed to the outside of the connector when the terminal fitting is locked by the lock.

5. The connector of claim 1, wherein the maneuverable recess is undercut to be converge along an insertion and withdrawal direction of the terminal filling into and from the housing.

6. The connector of claim 5, wherein a surface of the maneuverable recess towards the terminal fitting is substantially parallel to the terminal fitting.

7. The connector of claim 1, further comprising a disengagement jig for deflecting the lock, the disengaging jig comprising:

a main body having a leading end;

a disengaging portion at the leading end of the main body and configured for maneuvering the maneuverable recess by leverage action of the main body; and a restricting portion for contacting the front of the housing upon the leverage action, thereby restricting an inclination range of the main body.

8. The connector of claim 7, wherein the main body of the disengagement jig comprises a receiving portion for receiving a tab of the terminal fitting projecting from the front of the housing, and an inner surface of the receiving portion being formed with an escaping portion for avoiding an interference with the tab when the main body is inclined.

9. A connector, comprising a housing with opposite front and rear ends, at least one cavity extending between the front and rear ends of the housing, a resilient deformable lock projecting forward in the cavity and a deformation permitting space adjacent the lock, the lock being resiliently deformable into the deformation permitting space the lock having a leading end facing the front end of the housing, a locking surface formed on a portion of the leading end of the lock and adjacent the cavity and a maneuverable recess at a position on a leading surface of the lock between the locking surface and the deformation permitting space, the maneuverable recess being no wider than the locking surface in a direction transverse to a deformation direction of the lock, the maneuverable recess extending rearwardly into the leading surface of the lock to a position rearward of the locking surface.

10. The connector of claim 9, wherein two maneuverable recesses are arranged along a width direction of the lock.

11. The connector of claim 9, wherein the maneuverable recess is exposed from the front of the housing.

12. The connector of claim 9, wherein the maneuverable recess is formed by two converging surfaces.

* * * * *